US006780575B2

(12) United States Patent
Szajewski

(10) Patent No.: US 6,780,575 B2
(45) Date of Patent: Aug. 24, 2004

(54) RECORD-SHIFTED SCANNING OF SILVER-HALIDE-CONTAINING COLOR PHOTOGRAPHIC AND PHOTOTHERMOGRAPHIC ELEMENTS

(75) Inventor: Richard P. Szajewski, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/092,081

(22) Filed: Mar. 6, 2002

(65) Prior Publication Data

US 2002/0132175 A1 Sep. 19, 2002

Related U.S. Application Data

(63) Continuation-in-part of application No. 09/855,046, filed on May 14, 2001, now abandoned.
(60) Provisional application No. 60/211,364, filed on Jun. 13, 2000.

(51) Int. Cl.[7] ..... G03C 1/46
(52) U.S. Cl. ..... 430/503; 430/383; 430/505; 430/510; 430/543; 430/566; 430/944; 430/955; 430/959
(58) Field of Search ..... 430/21, 510, 543, 430/566, 619, 360, 383, 955, 944, 959, 503, 505

(56) References Cited

U.S. PATENT DOCUMENTS

| | | | | |
|---|---|---|---|---|
| 4,157,915 A | | 6/1979 | Hamaoka et al. | |
| 4,320,193 A | | 3/1982 | Robillard | |
| 4,473,635 A | * | 9/1984 | Ishikawa et al. | 430/405 |
| 4,789,623 A | | 12/1988 | Sato et al. | |
| 5,840,470 A | | 11/1998 | Bohan et al. | |
| 6,013,420 A | | 1/2000 | Wingender et al. | |
| 6,030,755 A | | 2/2000 | Matsumoto et al. | |
| 6,043,017 A | | 3/2000 | Bergthaller | |

FOREIGN PATENT DOCUMENTS

| | | | | |
|---|---|---|---|---|
| JP | 4-86658 | * | 3/1992 | G03C/8/40 |

* cited by examiner

*Primary Examiner*—Thorl Chea
(74) *Attorney, Agent, or Firm*—Chris P. Konkol

(57) ABSTRACT

The present invention is directed to a method of scanning silver-halide-containing color photographic and photothermographic film. In particular, the present invention comprises record shifting by means by employing at least one infrared dye in a color unit of the film, thereby forming at least one image record in the infrared. This expedient leads to the formation of high quality images, especially when scanning photothermographic elements in which the silver halide, metallic silver, and/or any organic silver salts have not been removed.

16 Claims, No Drawings

RECORD-SHIFTED SCANNING OF SILVER-HALIDE-CONTAINING COLOR PHOTOGRAPHIC AND PHOTOTHERMOGRAPHIC ELEMENTS

CROSS REFERENCE OF RELATED APPLICATIONS

This application is a Continuation-in-Part of U.S. application Ser. No. 09/855,046, filed May 14, 2001 abandoned, which claims the benefit of U.S. Pat. No. 60/211,364 filed Jun. 13, 2000.

FIELD OF THE INVENTION

The present invention is directed to a method of scanning silver-halide-containing color photographic and photothermographic film. In particular, the present invention comprises record shifting by means by employing at least one infrared dye in a color unit of the film, thereby forming at least one image record in the infrared region.

BACKGROUND OF THE INVENTION

It has become desirable to limit the amount of solvent or processing chemicals used in the processing of silver-halide films. A traditional photographic processing scheme for color film involves development, fixing, bleaching, and washing, each step typically involving immersion in a tank holding the necessary chemical solution. Images are then produced by optical printing. By scanning the film image following development, the subsequent processing solutions could be eliminated for the purposes of obtaining a color image. Instead, the scanned image could be used to directly provide the final image to the consumer.

By the use of photothermographic film, it would be possible to eliminate processing solutions altogether, or alternatively, to minimize the amount of processing solutions and the complex chemicals contained therein. A photothermographic (PTG) film by definition is a film that requires energy, typically heat, to effectuate development. A dry PTG film requires only heat; a solution-minimized PTG film may require small amounts of aqueous alkaline solution to effectuate development, which amounts may be only that required to swell the film without excess solution. Development is the process whereby silver ion is reduced to metallic silver and, in a color system, a dye is created in an image-wise fashion.

PROBLEM TO BE SOLVED BY THE INVENTION

In PTG films, the silver metal and silver halide is typically retained in the coating after the heat development. It can be difficult to scan through imagewise exposed and photochemically processed silver-halide films when the undeveloped silver halide is not removed from the film during processing. The retained silver halide is reflective, and this reflectivity appears as density in a scanner. The retained silver halide scatters light, decreasing sharpness and raising the overall density of the film, to the point in high-silver films of making the film unsuitable for scanning. High densities result in the introduction of Poisson noise into the electronic form of the scanned image, and this in turn results in decreased image quality. Furthermore, the retained silver halide can form non-image density in reaction to ambient/viewing/scanning light, rendering non-imagewise density, degrading signal-to noise of the original scene, and raising density even higher.

It is therefore an object of the present invention to improve the scanning of photothermographic film without removing the silver halide and/or metallic silver, or partially removing the same.

SUMMARY OF THE INVENTION

It has been found that the reflectivity of retained silver halide is quite dependent on wavelength and that blue light is more reflected than green light which in turn is more reflected than red light which in turn is more reflected than infrared light. Accordingly, it has been found that the expedient of forming at least one image record in the infrared leads to the formation of high quality images.

In one embodiment of the invention, record shifting is accomplished by providing a light-sensitive color element having a blue light-sensitive layer unit having a magenta dye forming coupler, a green light-sensitive layer having a cyan dye forming coupler, and a red light-sensitive layer having an infrared dye forming coupler.

DETAILED DESCRIPTION OF THE INVENTION

The present invention is directed to a chromogenic photographic or photothermographic film in which at least one layer comprises in reactive association a developing agent and a dye-forming coupler that forms dyes in the infrared region. The invention is also directed to a method of scanning such films in which the silver halide has not been removed or partially removed.

As indicated above, one embodiment of the present invention is directed to a photothermographic film comprising at least one red-light sensitive imaging layer or color unit comprising an infrared dye-forming coupler, at least one imaging layer or color unit comprising a blue-light sensitive layer comprising a magenta dye forming coupler, and at least one green-light sensitive imaging layer or color unit comprising a cyan dye-forming coupler. A color recording layer unit ("unit" or "color unit") can comprise one or more imaging layers, for example, three imaging layers, which layers are sensitive to the same color. Thus, any one or all of the imaging layers in a color unit can comprise an infrared dye-forming coupler.

This can be accomplished by using art known magenta, cyan and infrared dye forming couplers with a conventional developing agent such as a paraphenylene compound. These are typically 4-N,N-dialkylaminoanilines and 2-alkyl-4-N,N-dialkylaminoanilines. Other permutations of known dye forming couplers and color layer light sensitivity can be employed so long as at least one layer unit forms dyes in the infrared region.

In another embodiment of the present invention, record shifting is accomplished by providing a light-sensitive color photothermographic element comprising at least one blue light-sensitive layer or unit comprising a magenta dye-forming coupler, at least one green light sensitive layer or unit having a cyan dye forming coupler and at least one red light-sensitive layer having an infrared dye-forming coupler. This can be accomplished by employing conventional yellow, magenta and cyan dye forming couplers in combination with a hue shifting developing agent, for example, of the paraphenylene diamine type. These are typically 2,5-dialkyl-4-N,N-dialkylaminoanilines.

In yet another embodiment of the present invention, record shifting is accomplished by providing a light-sensitive photothermographic color element comprising a (at least one) blue light-sensitive layer or unit comprising a cyan dye-forming coupler, a green light-sensitive layer or unit comprising a near infrared dye-forming coupler, and a red light-sensitive layer or unit having a far infrared dye forming coupler. This can be accomplished by using art known magenta, cyan and infrared dye forming couplers in combination with a hue shifting paraphenylene diamine developer, typically 2,5-dialkyl-4-N,N-dialkylaminoanilines.

It has been found that shifting of the dye hues to the infrared results in images that are easier to scan since there is less light reflection during scanning of the film despite the presence of silver halide in the film.

A typical color negative film construction useful in the practice of the invention is illustrated by the following element, SCN-1:

| Element SCN-1 | |
|---|---|
| SOC | Surface Overcoat |
| BU | Blue Recording Layer Unit |
| IL1 | First Interlayer |
| GU | Green Recording Layer Unit |
| IL2 | Second Interlayer |
| RU | Red Recording Layer Unit |
| AHU | Antihalation Layer Unit |
| S | Support |
| SOC | Surface Overcoat |

The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Examples of useful supports are poly(vinylacetal) film, polystyrene film, poly (ethyleneterephthalate) film, poly(ethylene naphthalate) film, polycarbonate film, and related films and resinous materials, as well as paper, cloth, glass, metal, and other supports that withstand the anticipated processing conditions. The element can contain additional layers, such as filter layers, interlayers, overcoat layers, subbing layers, antihalation layers and the like. Transparent and reflective support constructions, including subbing layers to enhance adhesion, are disclosed in Section XV of *Research Disclosure*, September 1996, Number 389, Item 38957 (hereafter referred to as (*"Research Disclosure I"*).

Photographic elements of the present invention may also usefully include a magnetic recording material as described in *Research Disclosure*, Item 34390, November 1992, or a transparent magnetic recording layer such as a layer containing magnetic particles on the underside of a transparent support as in U.S. Pat. Nos. 4,279,945, and 4,302,523.

Each of blue, green and red recording layer units BU, GU and RU are formed of one or more hydrophilic colloid layers and contain at least one radiation-sensitive silver halide emulsion and coupler, including at least one dye image-forming coupler. It is preferred that the green, and red recording units are subdivided into at least two recording layer sub-units to provide increased recording latitude and reduced image granularity. In the simplest contemplated construction each of the layer units or layer sub-units consists of a single hydrophilic colloid layer containing emulsion and coupler. When coupler present in a layer unit or layer sub-unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 $\mu$m. In an alternative embodiment, sensitized layers can be coated on both faces of the support to form a so-called "duplitized" film.

In a preferred embodiment of this invention, the processed photographic film contains only limited amounts of color masking couplers, incorporated permanent Dmin adjusting dyes and incorporated permanent antihalation dyes. Generally, such films contain color masking couplers in total amounts up to about 0.6 mmol/m$^2$, preferably in amounts up to about 0.2 mmol/m$^2$, more preferably in amounts up to about 0.05 mmol/m$^2$, and most preferably in amounts up to about 0.01 mmol/m$^2$.

In the preferred embodiment, the incorporated permanent Dmin adjusting dyes are present in total amounts up to about 0.2 mmol/m$^2$, preferably in amounts up to about 0.1 mmol/m$^2$, more preferably in amounts up to about 0.02 mmol/m$^2$, and most preferably in amounts up to about 0.005 mmol/m$^2$. The incorporated permanent antihalation density is present at a level up to about 0.6 in blue, green or red density, more preferably at a level up to about 0.3 in blue, green or red density, even more preferably at a level up to about 0.1 in blue, green or red density, and most preferably at a level up to about 0.05 in blue, green or red Status M density.

Limiting the amount of color masking couplers, permanent antihalation density and incorporated permanent Dmin adjusting dyes serves to reduce the optical density of the films, after processing, in the 350 to 750 nm range, and thus improves the subsequent scanning and digitization of the imagewise exposed and processed films.

Overall, the limited Dmin and tone scale density enabled by controlling the quantity of incorporated color masking couplers, incorporated permanent Dmin adjusting dyes and antihalation and support optical density can serve to both limit scanning noise (which increases at high optical densities), and to improve the overall signal-to-noise characteristics of the film to be scanned. Relying on the digital correction step to provide color correction obviates the need for color masking couplers in the films.

In a preferred embodiment, the films useful in this invention have three color records, including a red light-sensitive color record having a peak spectral sensitivity between about 600 and 700 nm, a green light-sensitive color record having a peak spectral sensitivity between about 500 and 600 nm, and a blue light-sensitive color record having a peak spectral sensitivity between about 400 and 500 nm. While any combination of spectral sensitivities can be used in the films used in the practice or this invention, the spectral sensitivities described by Giorgianni, et al., U.S. Pat. Nos. 5,609,978 and 5,582,961 are particularly useful in this invention.

Any convenient selection from among conventional radiation-sensitive silver halide emulsions can be incorporated within the layer units and used to provide the spectral absorptances of the invention. Most commonly high bromide emulsions containing a minor amount of iodide are employed. To realize higher rates of processing, high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least 5 and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically contemplated. The grains preferably form surface latent images so that they produce negative images when processed in a surface developer in color negative film forms of the invention.

Illustrations of conventional radiation-sensitive silver halide emulsions are provided by *Research Disclosure I*, cited above, I. Emulsion grains and their preparation. Chemical sensitization of the emulsions, which can take any conventional form, is illustrated in section IV. Chemical sensitization. Compounds useful as chemical sensitizers, include, for example, active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 4 to 8, and temperatures of from 30 to 80° C. Spectral sensitization and sensitizing dyes, which can take any conventional form, are illustrated by section V. Spectral sensitization and desensitization. The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol or as a dispersion of solid particles. The emulsion layers also typically include one or more antifoggants or stabilizers, which can take any conventional form, as illustrated by section VII. Antifoggants and stabilizers.

The silver halide grains to be used in the invention may be prepared according to methods known in the art, such as those described in *Research Disclosure I*, cited above, and James, The Theory of the Photographic Process. These include methods such as ammoniacal emulsion making, neutral or acidic emulsion making, and others known in the art. These methods generally involve mixing a water soluble silver salt with a water soluble halide salt in the presence of a protective colloid, and controlling the temperature, pAg, pH values, etc., at suitable values during formation of the silver halide by precipitation.

In the course of grain precipitation one or more dopants (grain occlusions other than silver and halide) can be introduced to modify grain properties. For example, any of the various conventional dopants disclosed in *Research Disclosure I*, Section I. Emulsion grains and their preparation, sub-section G. Grain modifying conditions and adjustments, paragraphs (3), (4) and (5), can be present in the emulsions of the invention. In addition it is specifically contemplated to dope the grains with transition metal hexacoordination complexes containing one or more organic ligands, as taught by Olm et al U.S. Pat. No. 5,360,712, the disclosure of which is here incorporated by reference.

It is specifically contemplated to incorporate in the face centered cubic crystal lattice of the grains a dopant capable of increasing imaging speed by forming a shallow electron trap (hereinafter also referred to as a SET) as discussed in *Research Disclosure* Item 36736 published November 1994, here incorporated by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure, I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers. The vehicle can be present in the emulsion in any amount useful in photographic emulsions. The emulsion can also include any of the addenda known to be useful in photographic emulsions.

While any useful quantity of light sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements. Conversely, a silver coating coverage of at least 1.5 g of coated silver per m$^2$ of support surface area in the element is necessary to realize an exposure latitude of at least 2.7 log E while maintaining an adequately low graininess position for pictures intended to be enlarged.

The blue recording layer unit (BU) contains at least one dye image-forming coupler, the green recording layer unit (GU) contains at least one dye image-forming coupler, and the red recording layer unit (RU) contains at least one dye image-forming coupler. Any convenient combination of conventional dye image-forming couplers can be employed, so long as the images formed in the distinct film color records or units are distinguishable by the scanner at scanning. At least one of the BU, GU or RU contains an infrared dye forming coupler. Distinct infrared dye forming couplers can be employed in distinct units to carry distinct color records, as for example a near infrared dye forming coupler in one of BU, GU or RU and a far infrared dye forming coupler in another of BU, GU or RU. Conventional dye image-forming couplers are illustrated by *Research Disclosure I*, cited above, X. Dye image formers and modifiers, B. Image-dye-forming couplers. The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. It is preferred that the most sensitive emulsion be located nearest the source of exposing radiation and the slowest emulsion be located nearest the support.

One or more of the layer units of the invention is preferably subdivided into at least two, and more preferably three or more sub-unit layers. It is preferred that all light sensitive silver halide emulsions in the color recording unit have spectral sensitivity in the same region of the visible spectrum. In this embodiment, while all silver halide emulsions incorporated in the unit have spectral absorptance according to invention, it is expected that there are minor differences in spectral absorptance properties between them. In still more preferred embodiments, the sensitizations of the slower silver halide emulsions are specifically tailored to account for the light shielding effects of the faster silver halide emulsions of the layer unit that reside above them, in order to provide an imagewise uniform spectral response by the photographic recording material as exposure varies with low to high light levels. Thus higher proportions of peak light absorbing spectral sensitizing dyes may be desirable in the slower emulsions of the subdivided layer unit to account for on-peak shielding and broadening of the underlying layer spectral sensitivity.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate oxidized developing agent. Antistain agents (oxidized developing agent scavengers) can be selected from among those disclosed by *Research Disclosure I*, X. Dye image formers and modifiers, D. Hue modifiers/stabilization, paragraph (2). When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure I*, Section VIII. Absorbing and scattering materials, B. Absorbing materials. In elements of the instant invention, magenta colored filter materials are absent from IL2 and RU.

The antihalation layer unit AHU typically contains a removable or decolorizable light absorbing material, such as one or a combination of pigments and dyes. Suitable materials can be selected from among those disclosed in *Research Disclosure I*, Section VIII. Absorbing materials. A common alternative location for AHU is between the support S and the recording layer unit coated nearest the support.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure I*, Section IX. Coating physical property modifying addenda. The SOC overlying the emulsion layers additionally preferably contains an ultraviolet absorber, such as illustrated by *Research Disclosure I*, Section VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

The invention can be suitably applied to conventional color negative construction as illustrated. Color reversal film construction would take a similar form, with the exception that colored masking couplers would be completely absent; in typical forms, development inhibitor releasing couplers would also be absent. In preferred embodiments, the color negative elements are intended exclusively for scanning to produce three separate electronic color records. Thus the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region.

It is possible for a color layer unit to form a dye having an absorption half peak bandwidth in the near ultraviolet (300–400 nm) through the visible and through the near to far infrared (700–1200 nm), so long as the absorption half-peak bandwidths of the image dye in the layer units extend over substantially non-coextensive wavelength ranges. The term "substantially non-coextensive wavelength ranges" means that each image dye exhibits an absorption half-peak band width that extends over at least a 25 (preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half-peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

Each layer unit of the color negative elements of the invention produces a dye image characteristic curve gamma of less than 1.5, which facilitates obtaining an exposure latitude of at least 2.7 log E. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta$ log E) by doubling changes in density ($\Delta D$). Thus, gamma's as low as 1.0 or even 0.6 are contemplated and exposure latitudes of up to about 5.0 log E or higher are feasible. Gammas of greater than about 0.30 are preferred. Gammas of between about 0.4 and 0.5 are especially preferred.

Instead of employing dye-forming couplers, any of the conventional incorporated dye image generating compounds employed in multicolor imaging can be alternatively incorporated in the blue, green and red recording layer units. Dye images can be produced by the selective destruction, formation or physical removal of dyes as a function of exposure. For example, silver dye bleach processes are well known and commercially utilized for forming dye images by the selective destruction of incorporated image dyes. The silver dye bleach process is illustrated by *Research Disclosure I*, Section X. Dye image formers and modifiers, A. Silver dye bleach.

It is also well known that pre-formed image dyes can be incorporated in blue, green and red recording layer units, the dyes being chosen to be initially immobile, but capable of releasing the dye chromophore in a mobile moiety as a function of entering into a redox reaction with oxidized developing agent. These compounds are commonly referred to as redox dye releasers (RDR's). By washing out the released mobile dyes, a retained dye image is created that can be scanned. It is also possible to transfer the released mobile dyes to a receiver, where they are immobilized in a mordant layer. The image-bearing receiver can then be scanned. Initially the receiver is an integral part of the color negative element. When scanning is conducted with the receiver remaining an integral part of the element, the receiver typically contains a transparent support, the dye image bearing mordant layer just beneath the support, and a white reflective layer just beneath the mordant layer. Where the receiver is peeled from the color negative element to facilitate scanning of the dye image, the receiver support can be reflective, as is commonly the choice when the dye image is intended to be viewed, or transparent, which allows transmission scanning of the dye image. RDR's as well as dye image transfer systems in which they are incorporated are described in *Research Disclosure*, Vol. 151, November 1976, Item 15162.

It is also recognized that the dye image can be provided by compounds that are initially mobile, but are rendered immobile during imagewise development. Image transfer systems utilizing imaging dyes of this type have long been used in previously disclosed dye image transfer systems. These and other image transfer systems compatible with the practice of the invention are disclosed in *Research Disclosure*, Vol. 176, December 1978, Item 17643, XXIII. Image transfer systems.

A number of modifications of color negative elements have been suggested for accommodating scanning, as illustrated by *Research Disclosure I*, Section XIV. Scan facilitating features. These systems to the extent compatible with the color negative element constructions described above are contemplated for use in the practice of this invention.

It is also contemplated that the imaging element of this invention may be used with non-conventional sensitization schemes. For example, instead of using imaging layers sensitized to the red, green, and blue regions of the spectrum, the light-sensitive material may have one white-sensitive layer to record scene luminance, and two color-sensitive layers to record scene chrominance. Following development, the resulting image can be scanned and digitally reprocessed to reconstruct the full colors of the original scene as described in U.S. Pat. No. 5,962,205. The imaging element may also comprise a pan-sensitized emulsion with accompanying color-separation exposure. In this embodiment, the developers of the invention would give rise to a colored or neutral image that, in conjunction with the separation exposure, would enable full recovery of the original scene color values. In such an element, the image may be formed by either developed silver density, a combination of one or more conventional couplers, or "black" couplers such as resorcinol couplers. The separation exposure may be made either sequentially through appropriate filters, or simultaneously through a system of spatially discreet filter elements (commonly called a "color filter array").

When conventional image dyes are formed to read out the recorded scene exposures following chemical development of conventional exposed color photographic materials, the response of the red, green, and blue color recording units of the element can be accurately discerned by examining their densities. Densitometry is the measurement of transmitted light by a sample using selected colored filters to separate the imagewise response of the RGB image dye forming units into relatively independent channels. It is common to use Status M filters to gauge the response of color negative film elements intended for optical printing, and Status A filters for color reversal films intended for direct transmission viewing. In integral densitometry, the unwanted side and tail absorptions of the imperfect image dyes leads to a small amount of channel mixing, where part of the total response of, for example, a magenta channel may come from off-peak absorptions of either the yellow or cyan image dyes records, or both, in neutral characteristic curves. Such artifacts may be negligible in the measurement of a film's spectral sensitivity. By appropriate mathematical treatment of the integral density response, these unwanted off-peak density contributions can be completely corrected providing analytical densities, where the response of a given color record is independent of the spectral contributions of the other image dyes. Analytical density determination has been summarized in the *SPSE Handbook of Photographic Science and Engineering*, W. Thomas, editor, John Wiley and Sons, New York, 1973, Section 15.3, Color Densitometry, pp. 840–848.

Image noise can be reduced, where the images are obtained by scanning exposed and processed color negative film elements to obtain a manipulatable electronic record of the image pattern, followed by reconversion of the adjusted electronic record to a viewable form. Image sharpness and colorfulness can be increased by designing layer gamma ratios to be within a narrow range while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by color negative film elements with low gamma ratios, to improve overall curve shape and sharpness characteristics in a manner that is impossible to achieve by known printing techniques. Thus, images can be recreated from electronic image records derived from such color negative elements that are superior to those similarly derived from conventional color negative elements constructed to serve optical printing applications. The excellent imaging characteristics of the described element are obtained when the gamma ratio for each of the red, green and blue color recording units is less than 1.2. In a more preferred embodiment, the red, green, and blue light sensitive color forming units each exhibit gamma ratios of less than 1.15. In an even more preferred embodiment, the red and blue light sensitive color forming units each exhibit gamma ratios of less than 1.10. In a most preferred embodiment, the red, green, and blue light sensitive color forming units each exhibit gamma ratios of less than 1.10. In all cases, it is preferred that the individual color unit(s) exhibit gamma ratios of less than 1.15, more preferred that they exhibit gamma ratios of less than 1.10 and even more preferred that they exhibit gamma ratios of less than 1.05. In the same vein, the gamma ratios of the individual color records are preferably at least 0.80, more preferably at least 0.85 and most preferably at least 0.90. The gamma ratios of the layer units need not be equal. These low values of the gamma ratio are indicative of low levels of interlayer interaction, also known as interlayer interimage effects, between the layer units and are believed to account for the improved quality of the images after scanning and electronic manipulation. The apparently deleterious image characteristics that result from chemical interactions between the layer units need not be electronically suppressed during the image manipulation activity. The interactions are often difficult if not impossible to suppress properly using known electronic image manipulation schemes.

Elements having excellent light sensitivity are best employed in the practice of this invention. The elements should have a sensitivity of at least about ISO 50, preferably have a sensitivity of at least about ISO 100, and more preferably have a sensitivity of at least about ISO 200. Elements having a sensitivity of up to ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above the minimum density in each of the green light sensitive and least sensitive color recording unit of a color film. This definition conforms to the International Standards Organization (ISO) film speed rating. For the purposes of this application, if the color unit gammas differ from 0.65, the ASA or ISO speed is to be calculated by linearly amplifying or deamplifying the gamma vs. log E (exposure) curve to a value of 0.65 before determining the speed in the otherwise defined manner.

The present invention also contemplates the use of photographic elements of the present invention in what are often referred to as single use cameras (or "film with lens" units). These cameras are sold with film preloaded in them and the entire camera is returned to a processor with the exposed film remaining inside the camera. The one-time-use cameras employed in this invention can be any of those known in the art. These cameras can provide specific features as known in the art such as shutter means, film winding means, film advance means, waterproof housings, single or multiple lenses, lens selection means, variable aperture, focus or focal length lenses, means for monitoring lighting conditions, means for adjusting shutter times or lens characteristics based on lighting conditions or user provided instructions, and means for camera recording use conditions directly on the film. These features include, but are not limited to: providing simplified mechanisms for manually or automatically advancing film and resetting shutters as described at Skarman, U.S. Pat. No. 4,226,517; providing apparatus for automatic exposure control as described at Matterson et al., U.S. Pat. No. 4,345,835; moisture-proofing as described at Fujimura et al., U.S. Pat. No. 4,766,451; providing internal and external film casings as described at Ohmura et al, U.S. Pat. No. 4,751,536; providing means for recording use conditions on the film as described at Taniguchi et al, U.S. Pat. No. 4,780,735; providing lens fitted cameras as described at Arai, U.S. Pat. No. 4,804,987; providing film supports with superior anti-curl properties as described at Sasaki et al, U.S. Pat. No. 4,827,298; providing a viewfinder as described at Ohmura et al, U.S. Pat. No. 4,812,863; providing a lens of defined focal length and lens speed as described at Ushiro et al, U.S. Pat. No. 4,812,866; providing multiple film containers as described at Nakayama et al, U.S. Pat. No. 4,831,398 and at Ohmura et al, U.S. Pat. No. 4,833,495; providing films with improved anti-friction characteristics as described at Shiba, U.S. Pat. No. 4,866,469; providing winding mechanisms, rotating spools, or resilient sleeves as described at Mochida, U.S. Pat. No. 4,884,087; providing a film patrone or cartridge removable in an axial direction as described by Takei et al at U.S. Pat. Nos. 4,890,130 and 5,063,400; providing an electronic flash means as described at Ohmura et al, U.S. Pat. No. 4,896,178; providing an externally operable member for effecting exposure as described at Mochida et al, U.S. Pat. No. 4,954,857; providing film support with modified sprocket holes and means for advancing said film as described at Murakami, U.S. Pat. No. 5,049,908; providing internal mirrors as described at Hara, U.S. Pat. No. 5,084,719; and providing silver halide emulsions suitable for use on tightly wound spools as described at Yagi et al, European Patent Application 0,466,417 A.

While the film may be mounted in the one-time-use camera in any manner known in the art, it is especially preferred to mount the film in the one-time-use camera such that it is taken up on exposure by a thrust cartridge. Thrust cartridges are disclosed by Kataoka et al U.S. Pat. No. 5,226,613; by Zander U.S. Pat. No. 5,200,777; by Dowling et al U.S. Pat. No. 5,031,852; and by Robertson et al U.S. Pat. No. 4,834,306. Narrow bodied one-time-use cameras suitable for employing thrust cartridges in this way are described by Tobioka et al U.S. Pat. No. 5,692,221.

Cameras may contain a built-in processing capability, for example a heating element. Designs for such cameras including their use in an image capture and display system are disclosed in Stoebe, et al., U.S. patent application Ser. No. 09/388,573 filed Sep. 1, 1999, incorporated herein by reference. The use of a one-time use camera as disclosed in said application is particularly preferred in the practice of this invention.

Photographic elements of the present invention are preferably imagewise exposed using any of the known techniques, including those described in *Research Disclosure I*, Section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like). The photothermographic elements are also exposed by means of various forms of energy, including ultraviolet and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide.

The elements as discussed above may serve as origination material for some or all of the following processes: image scanning to produce an electronic rendition of the capture image, and subsequent digital processing of that rendition to manipulate, store, transmit, output, or display electronically that image.

In one embodiment of the present invention, the imaging element is a photothermograpic element, preferably in which the dye image is formed by the use of an incorporated developing agent, in reactive association with each color layer. More preferably, the incorporated developing agent is a blocked developing agent. Examples of blocked developers that can be used in photographic elements of the present invention include, but are not limited to, the blocked developing agents described in U.S. Pat. No. 3,342,599, to Reeves; *Research Disclosure* (129 (1975) pp. 27–30) published by Kenneth Mason Publications, Ltd., Dudley Annex, 12a North Street, Emsworth, Hampshire P010 7DQ, ENGLAND; U.S. Pat. No. 4,157,915, to Hamaoka et al.; U.S. Pat. No. 4,060,418, to Waxman and Mourning; and in U.S. Pat. No. 5,019,492.

In one embodiment of the invention, the blocked developer may be respresented by the following Structure I:

$$\text{DEV—(LINK 1)}_{1}\text{—(TIME)}_{m}\text{—(LINK 2)}_{n}\text{—B} \qquad \text{I}$$

wherein,

DEV is a silver-halide color developing agent;

LINK 1 and LINK 2 are linking groups;

TIME is a timing group;

1 is 0 or 1;

m is 0, 1, or 2;

n is 0 or 1;

1+n is 1 or 2;

B is a blocking group or B is:

$$\text{—B'—(LINK 2)}_{n}\text{—(TIME)}_{m}\text{—(LINK 1)}_{1}\text{—DEV}$$

wherein B' also blocks a second developing agent DEV.

In a preferred embodiment of the invention, LINK 1 or LINK 2 are of structure II:

II

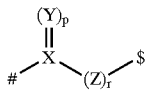

wherein

X represents carbon or sulfur;

Y represents oxygen, sulfur of N—$R_1$, where $R_1$ is substituted or unsubstituted alkyl or substituted or unsubstituted aryl;

p is 1 or 2;

Z represents carbon, oxygen or sulfur;

r is 0 or 1;

with the proviso that when X is carbon, both p and r are 1, when X is sulfur, Y is oxygen, p is 2 and r is 0;

# denotes the bond to PUG (for LINK 1) or TIME (for LINK 2):

$ denotes the bond to TIME (for LINK 1) or $T_{(t)}$ substituted carbon (for LINK 2).

Illustrative linking groups include, for example,

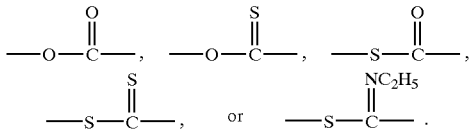

TIME is a timing group. Such groups are well-known in the art such as (1) groups utilizing an aromatic nucleophilic substitution reaction as disclosed in U.S. Pat. No. 5,262,291; (2) groups utilizing the cleavage reaction of a hemiacetal (U.S. Pat. No. 4,146,396, Japanese Applications 60-249148; 60-249149); (3) groups utilizing an electron transfer reaction along a conjugated system (U.S. Pat. Nos. 4,409,323; 4,421,845; Japanese Applications 57-188035; 58-98728; 58-209736; 58-209738); and (4) groups using an intramolecular nucleophilic substitution reaction (U.S. Pat. No. 4,248,962).

Illustrative timing groups are illustrated by formulae T-1 through T-4.

T-1

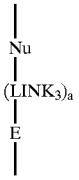

wherein:

Nu is a nucleophilic group;

E is an electrophilic group comprising one or more carbo- or hetero-aromatic rings, containing an electron deficient carbon atom;

LINK 3 is a linking group that provides 1 to 5 atoms in the direct path between the nucleopnilic site of Nu and the electron deficient carbon atom in E; and a is 0or 1.

Such timing groups include, for example:

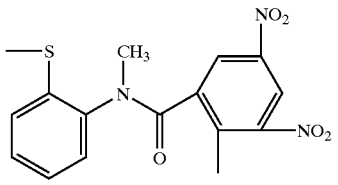

and

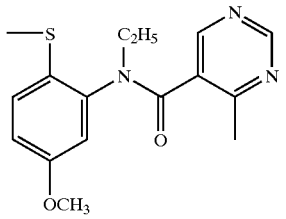

These timing groups are described more fully in U.S. Pat. No. 5,262,291, incorporated herein by reference.

T-2

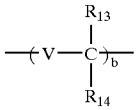

wherein

V represents an oxygen atom, a sulfur atom, or an

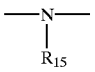

group;

$R_{13}$ and $R_{14}$ each represents a hydrogen atom or a substituent group;

$R_{15}$ represents a substituent group; and b represents 1 or 2.

Typical examples of $R_{13}$ and $R_{14}$, when they represent substituent groups, and $R_{15}$ include

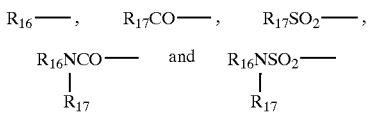

where, $R_{16}$ represents an aliphatic or aromatic hydrocarbon residue, or a heterocyclic group; and $R_{17}$ represents a hydrogen atom, an aliphatic or aromatic hydrocarbon residue, or a heterocyclic group, $R_{13}$, $R_{14}$ and $R_{15}$ each may represent a divalent group, and any two of them combine with each other to complete a ring structure. Specific examples of the group represented by formula (T-2) are illustrated below.

T-3

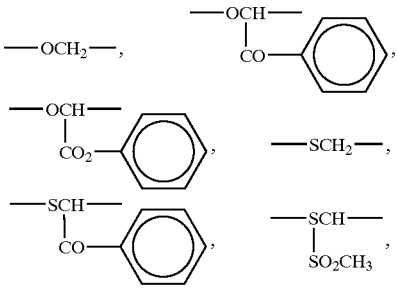

-continued

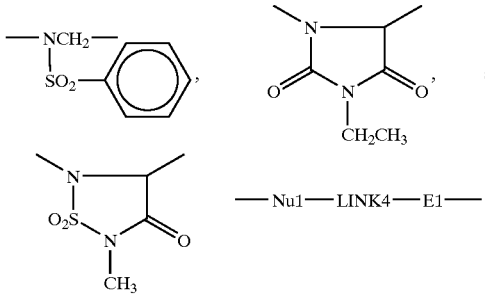

wherein Nu 1 represents a nucleophilic group, and an oxygen or sulfur atom can be given as an example of nucleophilic species; E1 represents an electrophilic group being a group which is subjected to nucleophilic attack by Nu 1; and LINK 4 represents a linking group which enables Nu 1 and E1 to have a steric arrangement such that an intramolecular nucleophilic substitution reaction can occur. Specific examples of the group represented by formula (T-3) are illustrated below.

T-4

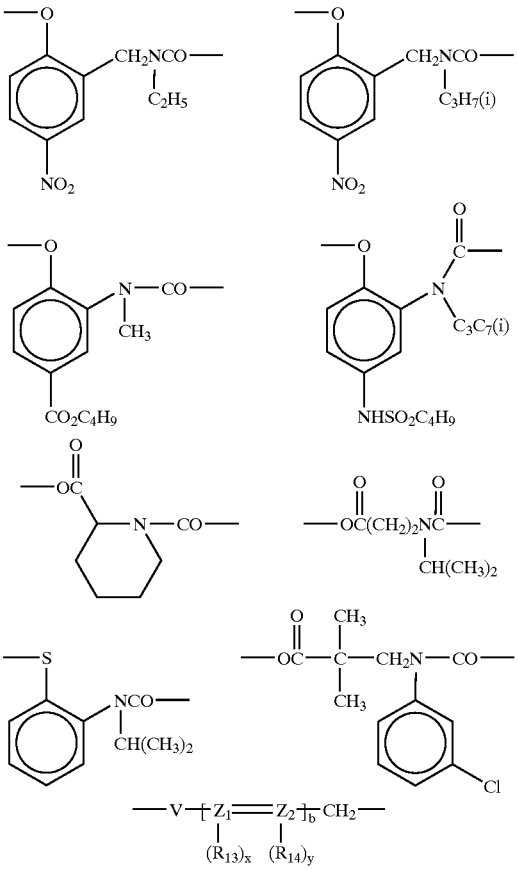

wherein V, $R_{13}$, $R_{14}$ and b all have the same meaning as in formula (T-2), respectively. In addition, $R_{13}$ and $R_{14}$ may be joined together to form a benzene ring or a heterocyclic ring, or V may be joined with $R_{13}$ or $R_{14}$ to form a benzene or heterocyclic ring. $Z_1$ and $Z_2$ each independently represents a carbon atom or a nitrogen atom, and x and y each represents 0 or 1.

Specific examples of the timing group (T-4) are illustrated below.

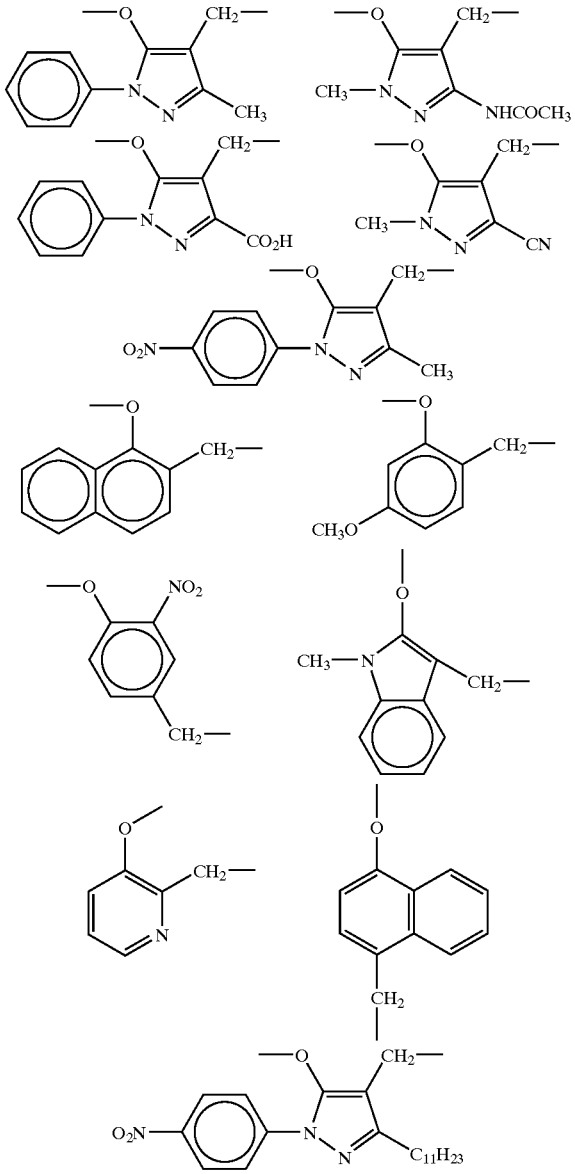

Illustrative developing agents that can be released by the blocked developers are:

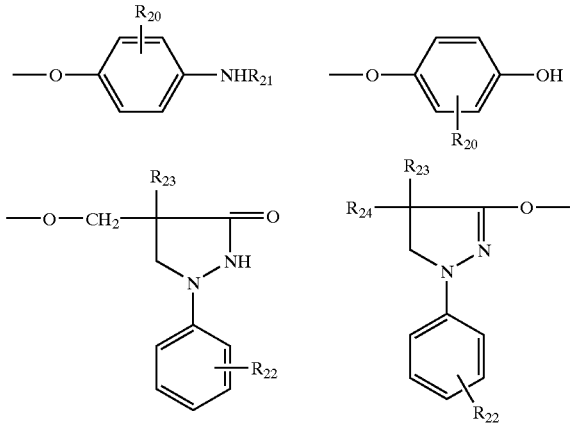

-continued

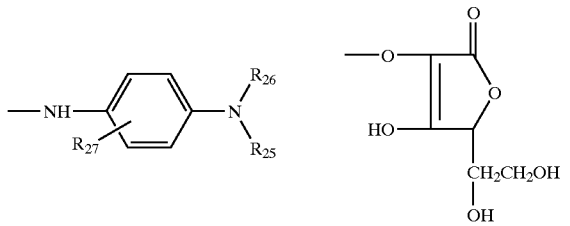

wherein $R_{20}$ is hydrogen, halogen, alkyl or alkoxy;

$R_{21}$ is a hydrogen or alkyl;

$R_{22}$ is hydrogen, alkyl, alkoxy or alkenedioxy; and $R_{23}$, $R_{24}$, $R_{25}$ $R_{26}$ and $R_{27}$ are hydrogen alkyl, hydroxyalkyl or sulfoalkyl.

Preferably, the color photothermographic element according to one embodiment of the present invention comprises a blocked developer having a half life of less than or equal to 20 minutes and a peak discrimination, at a temperature of at least 60° C., of at least 2.0, which blocked developer is represented by the following Structure I:

I

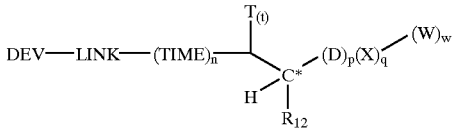

wherein:

DEV is a developing agent;

LINK is a linking group as defined above for LINK1 or LINK2;

TIME is a timing group as defined above;

n is 0, 1, or 2;

t is 0, 1, or 2, and when t is not 2, the necessary number of hydrogens (2 t) are present in the structure;

C* is tetrahedral ($sp^3$ hybridized) carbon;

p is 0 or 1;

q is 0 or 1;

w is 0 or 1;

p+q=1 and when p is 1, q and w are both 0; when q is 1, then w is 1;

$R_{12}$ is hydrogen, or a substituted or unsubstituted alkyl, cycloalkyl, aryl or heterocyclic group or $R_{12}$ can combine with W to form a ring;

T is independently selected from a substituted or unsubstituted (referring to the following T groups) alkyl group, cycloalkyl group, aryl, or heterocyclic group, an inorganic monovalent electron withdrawing group, or an inorganic divalent electron withdrawing group capped with at least one C1 to C10 organic group (either an $R_{13}$ or an $R_{13}$ and $R_{14}$ group), preferably capped with a substituted or unsubstituted alkyl or aryl group; or T is joined with W or $R_{12}$ to form a ring; or two T groups can combine to form a ring;

T is an activating group when T is an (organic or inorganic) electron withdrawing group, an aryl group substituted with one to seven electron withdrawing groups, or a substituted or unsubstituted heteroaromatic group. Preferably, T is an inorganic group such as halogen, —$NO_2$, —CN; a halogenated alkyl group, for example —$CF_3$, or an inorganic electron withdrawing group capped by $R_{13}$ or by $R_{13}$ and $R_{14}$, for example, —$SO_2R_{13}$, —$OSO_2R_{13}$, —$NR_{14}(SO_2R_{13})$, —$CO_2R_{13}$, —$COR_{13}$, —$NR_{14}(COR_{13})$, etc. A particularly preferred T group is an aryl group substituted with one to seven electron withdrawing groups.

D is a first activating group selected from substituted or unsubstituted (referring to the following D groups) heteroaromatic group or aryl group or monovalent electron withdrawing group, wherein the heteroaromatic can optionally form a ring with T or $R_{12}$;

X is a second activating group and is a divalent electron withdrawing group. The X groups comprise an oxidized carbon, sulfur, or phosphorous atom that is connected to at least one W group. Preferably, the X group does not contain any tetrahedral carbon atoms except for any side groups attached to a nitrogen, oxygen, sulfur or phosphorous atom. The X groups include, for example, —CO—, —$SO_2$—, —$SO_2O$—, —COO—, —$SO_2N(R_{15})$—, —$CON(R_{15})$—, —$OPO(OR_{15})$—, —$PO(OR_5)N(R_{16})$—, and the like, in which the atoms in the backbone of the X group (in a direct line between the C* and W) are not attached to any hydrogen atoms.

W is W' or a group represented by the following Structure IA:

IA

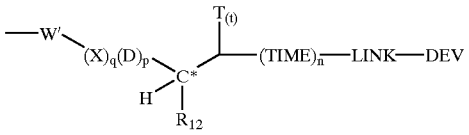

W' is independently selected from a substituted or unsubstituted (referring to the following W' groups) alkyl (preferably containing 1 to 6 carbon atoms), cycloalkyl (including bicycloalkyls, but preferably containing 4 to 6 carbon atoms), aryl (such as phenyl or naphthyl) or heterocyclic group; and wherein W' in combination with T or $R_{12}$ can form a ring (in the case of Structure IA, W' comprises a least one substituent, namely the moiety to the right of the W' group in Structure IA, which substituent is by definition activating, comprising either X or D);

W is an activating group when W has structure IA or when W' is an alkyl or cycloalkyl group substituted with one or more electron withdrawing groups; an aryl group substituted with one to seven electron withdrawing groups, a substituted or unsubstituted heteroaromatic group; or a non-aromatic heterocyclic when substituted with one or more electron withdrawing groups. More preferably, when W is substituted with an electron withdrawing group, the substituent is an inorganic group such as halogen, —$NO_2$, or —CN; or a halogenated alkyl group, e.g., —$CF_3$, or an inorganic group capped by $R_{13}$ (or by $R_{13}$ and $R_{14}$), for example —$SO_2R_{13}$, —$OSO_2R_{13}$, —$NR_{13}(SO_2R_{14})$, —$CO_2R_{13}$, —$COR_{13}$, —$NR_{13}(COR_{14})$, etc.

$R_{13}$, $R_{14}$, $R_{15}$, and $R_{16}$ can independently be selected from substituted or unsubstituted alkyl, aryl, or heterocyclic group, preferably having 1 to 6 carbon atoms, more preferably a phenyl or C1 to C6 alkyl group.

Any two members (which are not directly linked) of the following set: $R_{12}$, T, and either D or W, may be joined to form a ring, provided that creation of the ring will not interfere with the functioning of the blocking group.

In one embodiment of the invention, the blocked developer is selected from Structure I with the proviso that when t is 0, then D is not —CN or substituted or unsubstituted aryl and X is not —$SO_2$— when W is substituted or unsubstituted aryl or alkyl; and when t is not an activating group, then X is not —$SO_2$— when W is a substituted or unsubstituted aryl.

In the above Structure I, the T, $R_{12}$, X or D, W groups are selected such that the blocked developer exhibits a half life of less than or equal to 20 minutes (as determined in the Examples) and a peak discrimination, at a temperature of at least 60° C., of at least 2.0. The specified half-life can be obtained by the use of activating groups in certain positions in the blocking moiety of the blocked developer of Structure I. More specifically, it has been found that the specified half-life can be obtained by the use of activating groups in the D or X position. Further activation to achieve the specified half-life may be obtained by the use of activating groups in one or more of the T and/or W positions in Structure I. As indicated above, the activating groups is herein meant electron withdrawing groups, heteroaromatic groups, or aryl groups substituted with one or more electron withdrawing groups. In one embodiment of the invention, the specified half life is obtained by the presence of activating groups, in addition to D or X, in at least one of the T or W groups.

By the term inorganic is herein meant a group not containing carbon excepting carbonates, cyanides, and cyanates. The term heterocyclic herein includes aromatic and non-aromatic rings containing at least one (preferably 1 to 3) heteroatoms in the ring. If the named groups for a symbol such as T in Structure I apparently overlap, the narrower named group is excluded from the broader named group solely to avoid any such apparent overlap. Thus, for example, heteroaromatic groups in the definition of T may be electron withdrawing in nature, but are not included under monovalent or divalent electron withdrawing groups as they are defined herein.

In has further been found that the necessary half-life can be obtained by the use of activating groups in the D or X position, with further activation as necessary to achieve the necessary half-life by the use of electron withdrawing or heteroaromatic groups in the T and/or W positions in Structure I. By the term activating groups is meant electron withdrawing groups, heteroaromatic groups, or aryl groups substituted with one or more electron withdrawing groups. Preferably, in addition to D or X, at least one of T or W is an activating group.

When referring to electron withdrawing groups, this can be indicated or estimated by the Hammett substituent constants ($\sigma_p$, $\sigma_m$), as described by L. P. Hammett in Physical Organic Chemisty (McGraw-Hill Book Co., NY, 1940), or by the Taft polar substituent constants ($\sigma_I$) as defined by R. W. Taft in Steric Effects in Organic Chemistry (Wiley and Sons, NY, 1956), and in other standard organic textbooks. The $\sigma_p$ and $\sigma_m$ parameters, which were used first to characterize the ability of benzene ring-substituents (in the para or meta position) to affect the electronic nature of a reaction site, were originally quantified by their effect on the pKa of benzoic acid. Subsequent work has extended and refined the original concept and data, and for the purposes of prediction and correlation, standard sets of $\sigma_p$ and $\sigma_m$ are widely available in the chemical literature, as for example in C. Hansch et al., J. Med. Chem., 17, 1207 (1973). For substituents attached to a tetrahedral carbon instead of aryl groups, the inductive substituent constant $\sigma_I$ is herein used to characterize the electronic property. Preferably, an electron withdrawing group on an aryl ring has a $\sigma_p$ or $\sigma_m$ of greater than zero, more preferably greater than 0.05, most preferably greater than 0.1. The $\sigma_p$ is used to define electron withdrawing groups on aryl groups when the substituent is neither para nor meta. Similarly, an electron withdrawing group on a tetrahedral carbon preferably has a $\sigma_I$ of greater than zero, more preferably greater than 0.05, and most preferably greater than 0.1. In the event of a divalent group such as —$SO_2$—$^{\lambda}$, the $\sigma_I$ used is for the methyl substituted analogue such as —$SO_2CH_3$ ($\sigma_I$=0.59). When more than one electron withdrawing group is present, then the summation of the substituent constants is used to estimate or characterize the total effect of the substituents.

More preferably, the blocked developers used in the present invention is within Structure III above, but represented by the following narrower Structure IV:

Structure IV

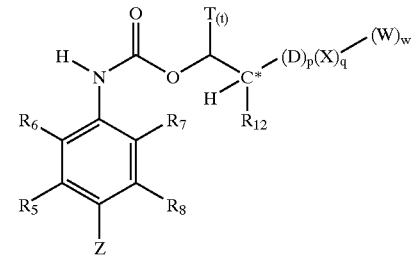

wherein:

Z is OH or $NR_2R_3$, where $R_2$ and $R_3$ are independently hydrogen or a substituted or unsubstituted alkyl group or $R_2$ and $R_3$ are connected to form a ring;

$R_5$, $R_6$, $R_7$, and $R_8$ are independently hydrogen, halogen, hydroxy, amino, alkoxy, carbonamido, sulfonamido, alkylsulfonamido or alkyl, or $R_5$ can connect with $R_3$ or $R_6$ and/or $R_8$ can connect to $R_2$ or $R_7$ to form a ring;

W is either W' or a group represented by the following Structure IVA:

Structure IVA

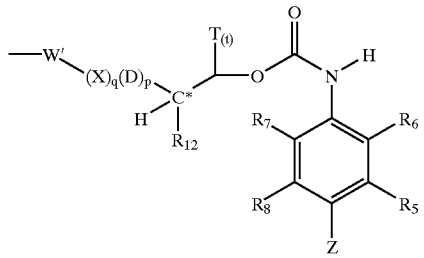

wherein T, t, C*, $R_{12}$, D, p, X, q, W' and w are as defined above, including, but not limited to, the preferred groups.

Again, the present invention includes photothermographic elements comprising blocked developers according to Structure III which blocked developers have a half-life ($t_{1/2}$)≦20 min (as determined below).

When referring to heteroaromatic groups or substituents, the heteroaromatic group is preferably a 5- or 6-membered ring containing one or more hetero atoms, such as N, O, S or Se. Preferably, the heteroaromatic group comprises a substituted or unsubstituted benzimidazolyl, benzothiazolyl, benzoxazolyl, benzothienyl, benzofuryl, furyl, imidazolyl, indazolyl, indolyl, isoquinolyl, isothiazolyl, isoxazolyl, oxazolyl, picolinyl, purinyl, pyranyl, pyrazinyl, pyrazolyl, pyridyl, pyrimidinyl, pyrrolyl, quinaldinyl, quinazolinyl, quinolyl, quinoxalinyl, tetrazolyl, thiadiazolyl, thiatriazolyl, thiazolyl, thienyl, and triazolyl group. Particularly preferred are: 2-imidazolyl, 2-benzimidazolyl, 2-thiazolyl, 2-benzothiazolyl, 2-oxazolyl, 2-benzoxazolyl, 2-pyridyl, 2-quinolinyl, 1-isoquinolinyl, 2-pyrrolyl, 2-indolyl, 2-thiophenyl, 2-benzothiophenyl, 2-furyl, 2-benzofuryl, 2-,4-, or 5-pyrimidinyl, 2-pyrazinyl, 3-,4-, or 5-pyrazolyl, 3-indazolyl, 2- and 3-thienyl, 2-(1,3,4-triazolyl), 4-or 5-(1,2,3-triazolyl), 5-(1,2,3,4-tetrazolyl). The heterocyclic group may be further substituted. Preferred substituents are alkyl and alkoxy groups containing 1 to 6 carbon atoms.

When reference in this application is made to a particular moiety or group, "substituted or unsubstituted" means that the moiety may be unsubstituted or substituted with one or more substituents (up to the maximum possible number), for example, substituted or unsubstituted alkyl, substituted or unsubstituted benzene (with up to five substituents), substituted or unsubstituted heteroaromatic (with up to five substituents), and substituted or unsubstituted heterocyclic (with up to five substituents). Generally, unless otherwise specifically stated, substituent groups usable on molecules herein include any groups, whether substituted or unsubstituted, which do not destroy properties necessary for the photographic utility. Examples of substituents on any of the mentioned groups can include known substituents, such as: halogen, for example, chloro, fluoro, bromo, iodo; alkoxy, particularly those "lower alkyl" (that is, with 1 to 6 carbon atoms), for example, methoxy, ethoxy; substituted or unsubstituted alkyl, particularly lower alkyl (for example, methyl, trifluoromethyl); thioalkyl (for example, methylthio or ethylthio), particularly either of those with 1 to 6 carbon atoms; substituted and unsubstituted aryl, particularly those having from 6 to 20 carbon atoms (for example, phenyl); and substituted or unsubstituted heteroaryl, particularly those having a 5 or 6-membered ring containing 1 to 3 heteroatoms selected from N, O, or S (for example, pyridyl, thienyl, furyl, pyrrolyl); acid or acid salt groups such as any of those described below; and others known in the art. Alkyl substituents may specifically include "lower alkyl" (that is, having 1–6 carbon atoms), for example, methyl, ethyl, and the like. Cycloalkyl when appropriate includes bicycloalkyl. Further, with regard to any alkyl group or alkylene group, it will be understood that these can be branched, unbranched, or cyclic.

The following are representative examples of photographically useful blocked developers for use in the invention:

D-1

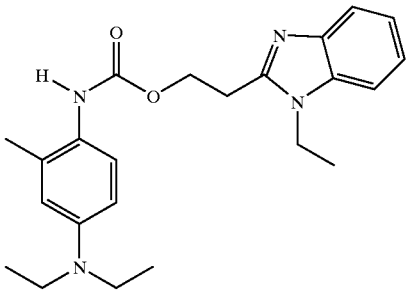

D-2

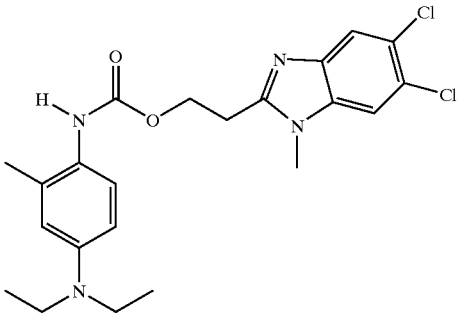

-continued

D-3

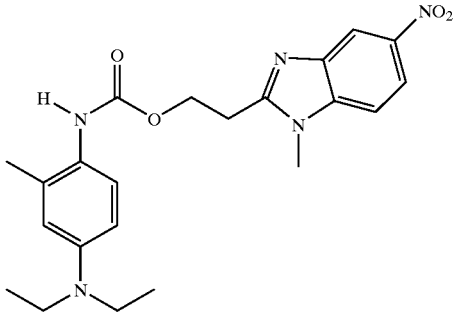

D-4

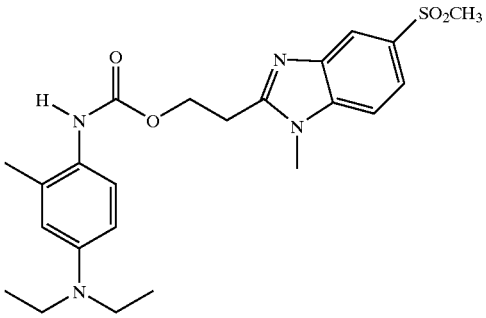

D-5

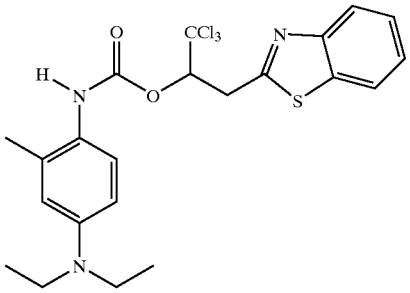

D-6

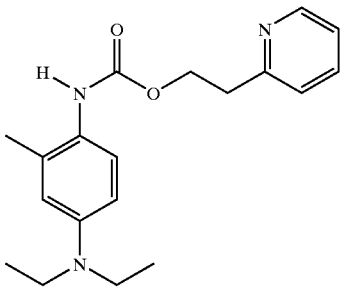

D-7

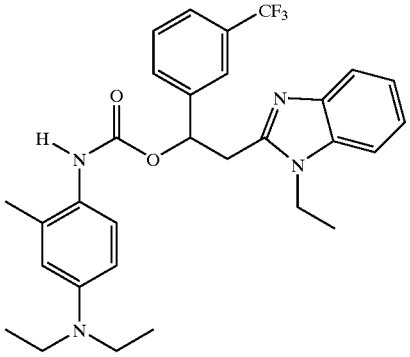

-continued
D-8
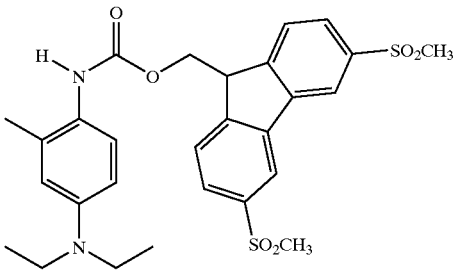
D-9
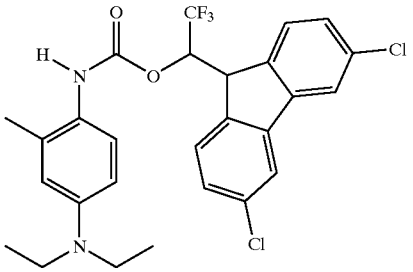
D-10
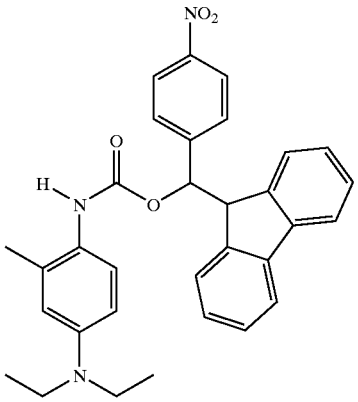
D-11
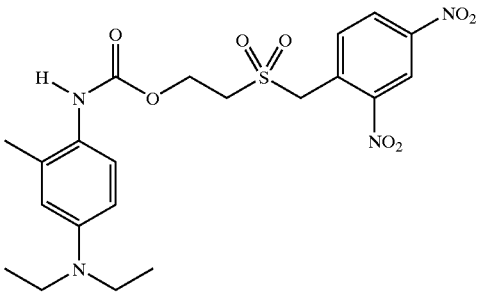
D-12
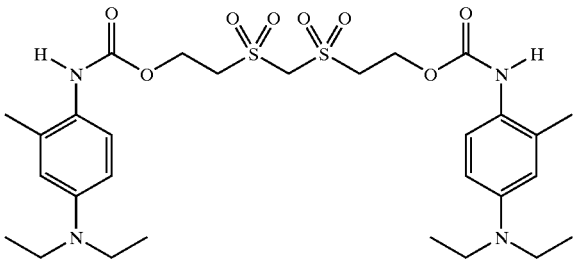
-continued
D-13
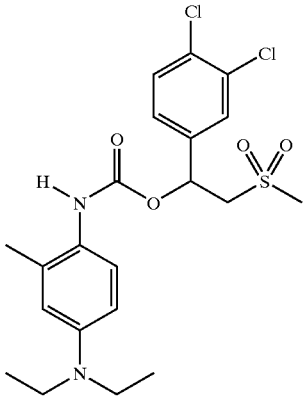
D-14
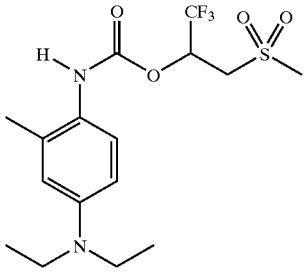
D-15
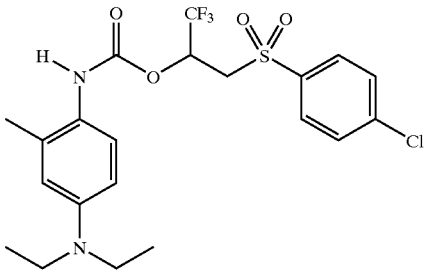
D-16
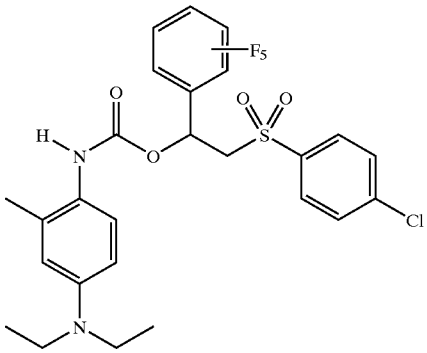

-continued
D-17
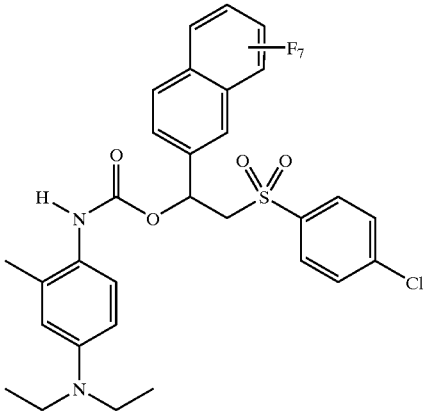
D-18
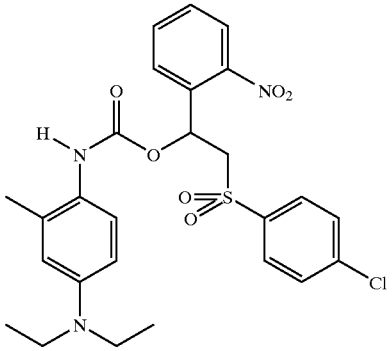
D-19
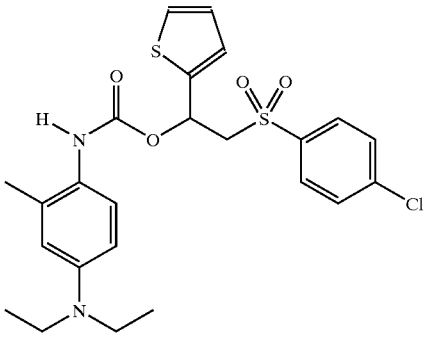
D-20
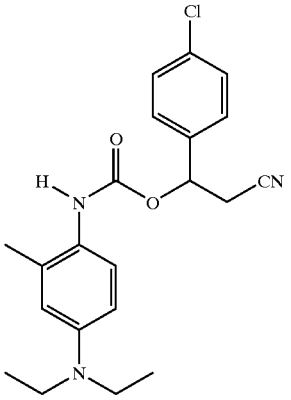
-continued
D-21
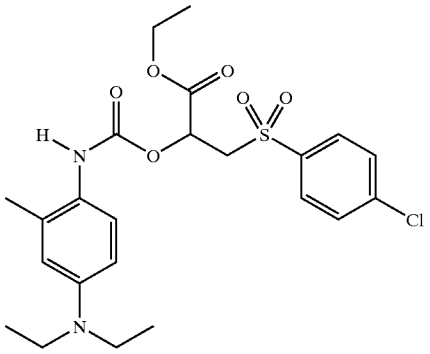
D-22
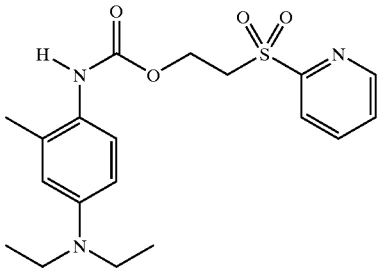
D-23
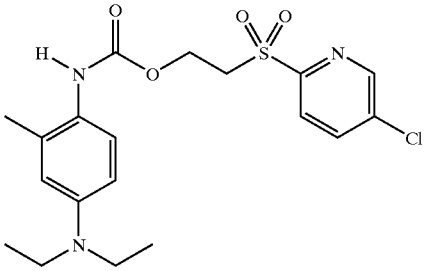
D-24
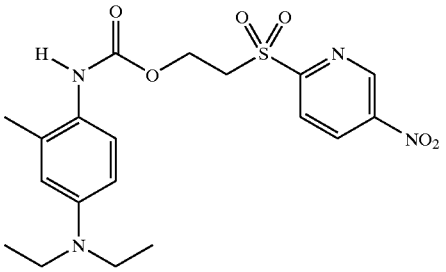
D-25
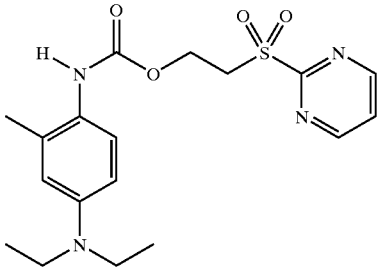

-continued
D-26
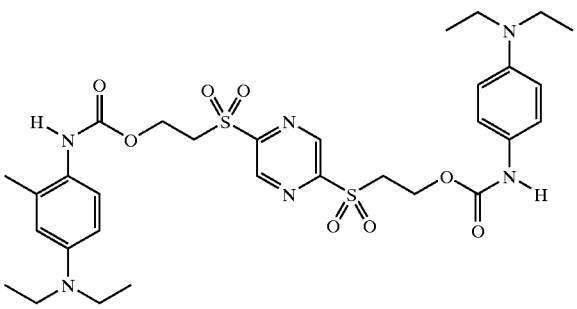
D-27
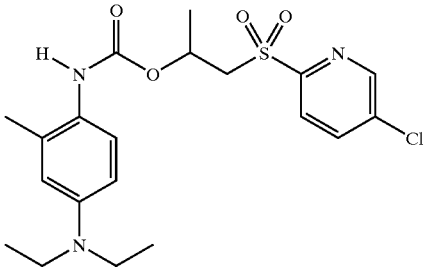
D-28
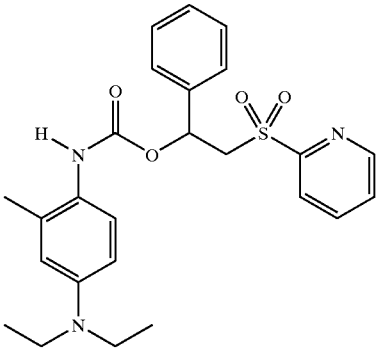
D-29
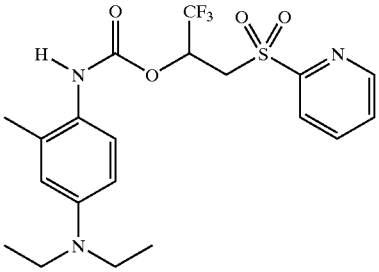
D-30
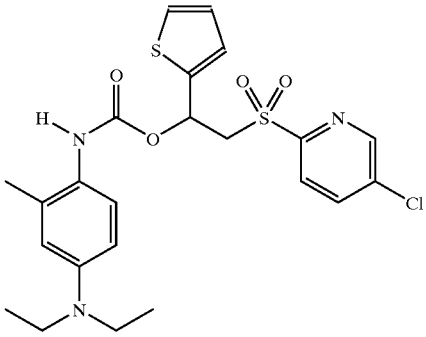
-continued
D-31
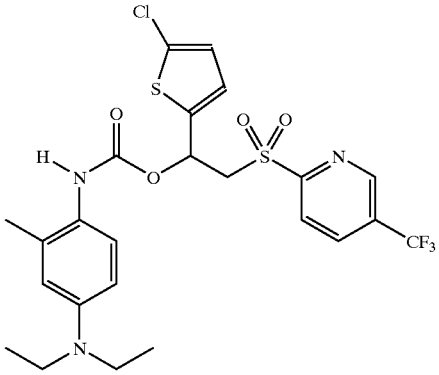
D-32
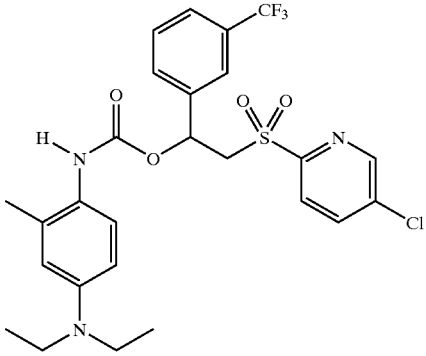
D-33
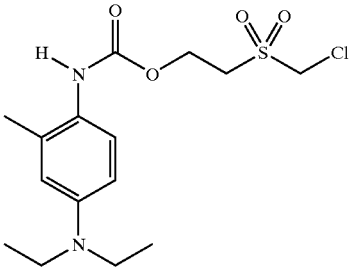
D-34
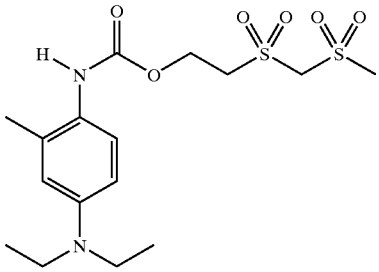
D-35
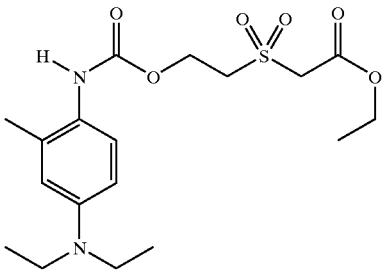

-continued
D-36
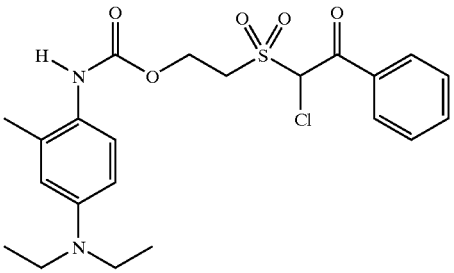
D-37
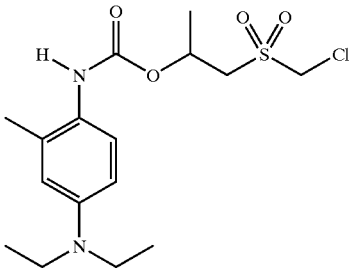
D-38
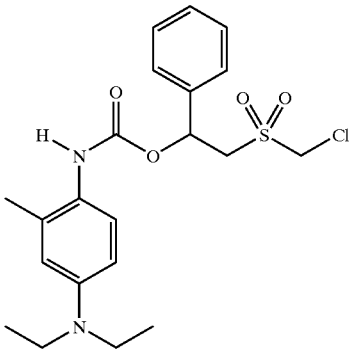
D-39
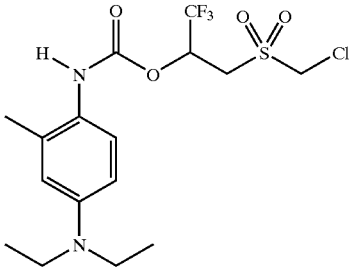
D-40
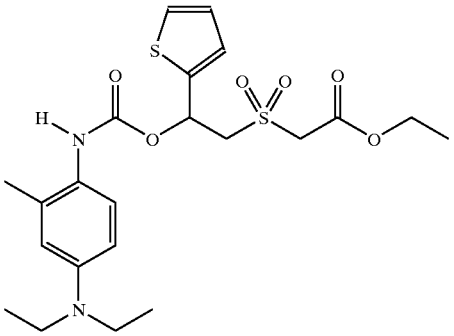
-continued
D-41
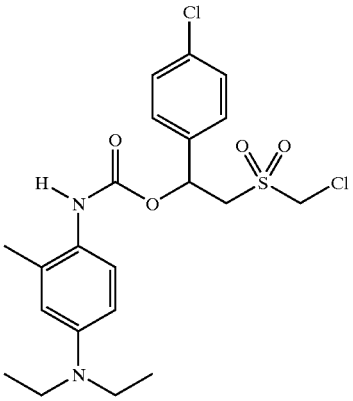
D-42
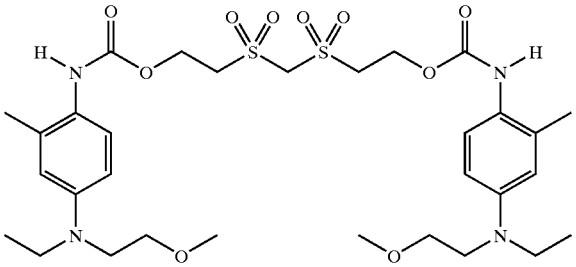
D-43
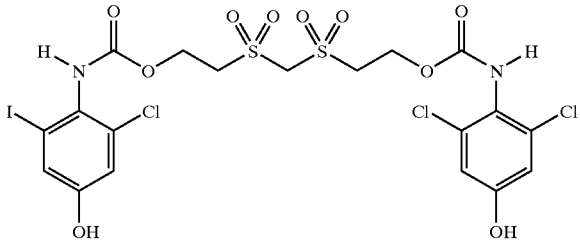
D-44
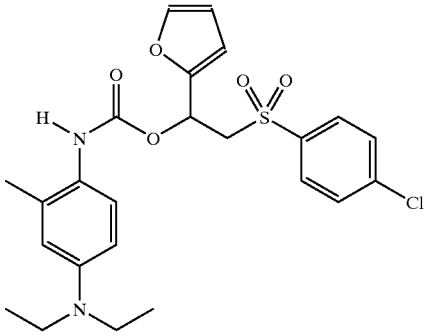
D-45
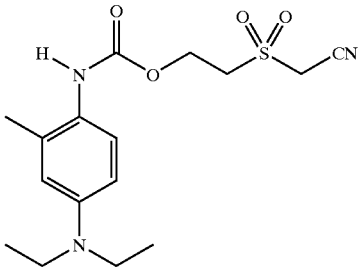

-continued

D-46

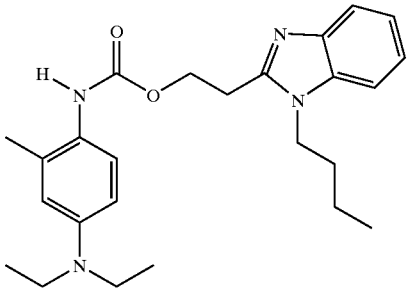

Photothermographic elements may be intended for different forms of processing, for example, types of processing systems include:

Type I: Thermal process systems (thermographic and photothermographic), where processing is initiated solely by the application of heat to the imaging element.

Type II: Low volume systems, where film processing is initiated by contact to a processing solution, but where the processing solution volume is comparable to the total volume of the imaging layer to be processed. This type of system may include the addition of non solution processing aids, such as the application of heat or of a laminate layer that is applied at the time of processing. Types I and II will now be described in detail in turn.

Type I: Thermographic and Photothermographic Systems

Photothermographic elements of the type described in *Research Disclosure* 17029 are included by reference. The photothermographic elements may be of type A or type B as disclosed in *Research Disclosure I*. Type A elements contain in reactive association a photosensitive silver halide, a reducing agent or developer, an activator, and a coating vehicle or binder. In these systems development occurs by reduction of silver ions in the photosensitive silver halide to metallic silver. Type B systems can contain all of the elements of a type A system in addition to a salt or complex of an organic compound with silver ion. In these systems, this organic complex is reduced during development to yield silver metal. The organic silver salt will be referred to as the silver donor. References describing such imaging elements include, for example, U.S. Pat. Nos. 3,457,075; 4,459,350; 4,264,725 and 4,741,992.

The photothermographic element comprises a photosensitive component that consists essentially of photographic silver halide. In the type B photothermographic material it is believed that the latent image silver from the silver halide acts as a catalyst for the described image-forming combination upon processing. In these systems, a preferred concentration of photographic silver halide is within the range of 0.01 to 100 moles of photographic silver halide per mole of silver donor in the photothermographic material.

The Type B photothermographic element comprises an oxidation-reduction image forming combination that contains an organic silver salt oxidizing agent. The organic silver salt is a silver salt which is comparatively stable to light, but aids in the formation of a silver image when heated to 80° C. or higher in the presence of an exposed photocatalyst (i.e., the photosensitive silver halide) and a reducing agent.

Suitable organic silver salts include silver salts of organic compounds having a carboxyl group. Preferred examples thereof include a silver salt of an aliphatic carboxylic acid and a silver salt of an aromatic carboxylic acid. Preferred examples of the silver salts of aliphatic carboxylic acids include silver behenate, silver stearate, silver oleate, silver laureate, silver caprate, silver myristate, silver palmitate, silver maleate, silver fumarate, silver tartarate, silver furoate, silver linoleate, silver butyrate and silver camphorate, mixtures thereof, etc. Silver salts which are substitutable with a halogen atom or a hydroxyl group can also be effectively used. Preferred examples of the silver salts of aromatic carboxylic acid and other carboxyl group-containing compounds include silver benzoate, a silver-substituted benzoate such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate, etc., silver gallate, silver tannate, silver phthalate, silver terephthalate, silver salicylate, silver phenylacetate, silver pyromellilate, a silver salt of 3-carboxymethyl-4-methyl-4-thiazoline-2-thione or the like as described in U.S. Pat. No. 3,785,830, and silver salt of an aliphatic carboxylic acid containing a thioether group as described in U.S. Pat. No. 3,330,663.

Silver salts of mercapto or thione substituted compounds having a heterocyclic nucleus containing 5 or 6 ring atoms, at least one of which is nitrogen, with other ring atoms including carbon and up to two hetero-atoms selected from among oxygen, sulfur and nitrogen are specifically contemplated. Typical preferred heterocyclic nuclei include triazole, oxazole, thiazole, thiazoline, imidazoline, imidazole, diazole, pyridine and triazine. Preferred examples of these heterocyclic compounds include a silver salt of 3-mercapto-4-phenyl-1,2,4 triazole, a silver salt of 2-mercaptobenzimidazole, a silver salt of 2-mercapto-5-aminothiadiazole, a silver salt of 2-(2-ethyl-glycolamido) benzothiazole, a silver salt of 5-carboxylic-1-methyl-2-phenyl-4-thiopyridine, a silver salt of mercaptotriazine, a silver salt of 2-mercaptobenzoxazole, a silver salt as described in U.S. Pat. No. 4,123,274, for example, a silver salt of 1,2,4-mercaptothiazole derivative such as a silver salt of 3-amino-5-benzylthio-1, 2,4-thiazole, a silver salt of a thione compound such as a silver salt of 3-(2-carboxyethyl)-4-methyl-4-thiazoline-2-thione as disclosed in U.S. Pat. No. 3,201,678. Examples of other useful mercapto or thione substituted compounds that do not contain a heterocyclic nucleus are illustrated by the following: a silver salt of thioglycolic acid such as a silver salt of a S-alkylthioglycolic acid (wherein the alkyl group has from 12 to 22 carbon atoms) as described in Japanese patent application 28221/73, a silver salt of a dithiocarboxylic acid such as a silver salt of dithioacetic acid, and a silver salt of thioamide.

Furthermore, a silver salt of a compound containing an imino group can be used. Preferred examples of these compounds include a silver salt of benzotriazole and a derivative thereof as described in Japanese patent publications 30270/69 and 18146/70, for example a silver salt of benzotriazole or methylbenzotriazole, etc., a silver salt of a halogen substituted benzotriazole, such as a silver salt of 5-chlorobenzotriazole, etc., a silver salt of 1,2,4-triazole, a silver salt of 3-amino-5-mercaptobenzyl-1,2,4-triazole, of 1H-tetrazole as described in U.S. Pat. No. 4,220,709, a silver salt of imidazole and an imidazole derivative, and the like.

It is also found convenient to use silver half soap, of which an equimolar blend of a silver behenate with behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the silver behenate full soap, containing not more than about 4 or 5 percent of free behenic acid and analyzing about 25.2 percent silver may be used. A method for making silver soap dispersions is well known in the art and is disclosed in *Research Disclosure* October 1983 (23419) and U.S. Pat. No. 3,985,565.

Silver salts complexes may also be prepared by mixture of aqueous solutions of a silver ionic species, such as silver nitrate, and a solution of the organic ligand to be complexed with silver. The mixture process may take any convenient form, including those employed in the process of silver halide precipitation. A stabilizer may be used to avoid flocculation of the silver complex particles. The stabilizer may be any of those materials known to be useful in the photographic art, such as, but not limited to, gelatin, polyvinyl alcohol or polymeric or monomeric surfactants.

The photosensitive silver halide grains and the organic silver salt are coated so that they are in catalytic proximity during development. They can be coated in contiguous layers, but are preferably mixed prior to coating. Conventional mixing techniques are illustrated by *Research Disclosure*, Item 17029, cited above, as well as U.S. Pat. No. 3,700,458 and published Japanese patent applications Nos. 32928/75, 13224/74, 17216/75 and 42729/76.

A reducing agent in addition to the blocked developer may be included. The reducing agent for the organic silver salt may be any material, preferably organic material, that can reduce silver ion to metallic silver. Conventional photographic developers such as 3-pyrazolidinones, hydroquinones, p-aminophenols, p-phenylenediamines and catechol are useful, but hindered phenol reducing agents are preferred. The reducing agent is preferably present in a concentration ranging from 5 to 25 percent of the photothermographic layer.

A wide range of reducing agents has been disclosed in dry silver systems including amidoximes such as phenylamidoxime, 2-thienylamidoxime and p-phenoxyphenylamidoxime, azines (e.g., 4-hydroxy-3,5-dimethoxybenzaldehydeazine); a combination of aliphatic carboxylic acid aryl hydrazides and ascorbic acid, such as 2,2'-bis(hydroxymethyl)propionylbetaphenyl hydrazide in combination with ascorbic acid; an combination of polyhydroxybenzene and hydroxylamine, a reductone and/or a hydrazine, e.g., a combination of hydroquinone and bis (ethoxyethyl)hydroxylamine, piperidinohexose reductone or formyl-4-methylphenylhydrazine, hydroxamic acids such as phenylhydroxamic acid, p-hydroxyphenyl-hydroxamic acid, and o-alaninehydroxamic acid; a combination of azines and sulfonamidophenols, e.g., phenothiazine and 2,6-dichloro-4-benzenesulfonamidophenol; α-cyano-phenylacetic acid derivatives such as ethyl α-cyano-2-methylphenylacetate, ethyl α-cyano-phenylacetate; bis-β-naphthols as illustrated by 2,2'-dihydroxyl-1-binaphthyl, 6,6'-dibromo-2,2'-dihydroxy-1,1 '-binaphthyl, and bis(2-hydroxy-1-naphthyl) methane; a combination of bis-o-naphthol and a 1,3-dihydroxybenzene derivative, (e.g., 2,4-dihydroxybenzophenone or 2,4-dihydroxyacetophenone); 5-pyrazolones such as 3-methyl-1-phenyl-5-pyrazolone, reductones as illustrated by dimethylaminohexose reductone, anhydrodihydroaminohexose reductone, and anhydrodihydro-piperidone-hexose reductone; sulfamidophenol reducing agents such as 2,6-dichloro-4-benzenesulfon-amido-phenol, and p-benzenesulfonamidophenol; 2-phenylindane-1,3-dione and the like; chromans such as 2,2-dimethyl-7-t-butyl-6-hydroxychroman; 1,4-dihydropyridines such as 2,6-dimethoxy-3,5-dicarbethoxy-1,4-dihydropyridene; bisphenols, e.g., bis(2-hydroxy-3-t-butyl-5-methylphenyl)-methane; 2,2-bis(4-hydroxy-3-methylphenyl)-propane; 4,4-ethylidene-bis(2-t-butyl-6-methylphenol); and2,2-bis(3,5-dimethyl-4-hydroxyphenyl) propane; ascorbic acid derivatives, e.g., 1-ascorbyl-palmitate, ascorbylstearate and unsaturated aldehydes and ketones, such as benzyl and diacetyl; pyrazolidin-3-ones; and certain indane-1,3-diones.

An optimum concentration of organic reducing agent in the photothermographic element varies depending upon such factors as the particular photothermographic element, desired image, processing conditions, the particular organic silver salt and the particular oxidizing agent.

The photothermographic element can comprise a thermal solvent. Examples of useful thermal solvents. Examples of thermal solvents, for example, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, and benzenesulfonamide. Prior-art thermal solvents are disclosed, for example, in U.S. Pat. No. 6,013,420 to Windender. Examples of toning agents and toning agent combinations are described in, for example, *Research Disclosure*, June 1978, Item No. 17029 and U.S. Pat. No. 4,123,282.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, U.S. Pat. No. 4,459,350. Other examples of useful stabilizers include azole thioethers and blocked azolinethione stabilizer precursors and carbamoyl stabilizer precursors, such as described in U.S. Pat. No. 3,877,940.

The photothermographic elements preferably contain various colloids and polymers alone or in combination as vehicles and binders and in various layers. Useful materials are hydrophilic or hydrophobic. They are transparent or translucent and include both naturally occurring substances, such as gelatin, gelatin derivatives, cellulose derivatives, polysaccharides, such as dextran, gum arabic and the like; and synthetic polymeric substances, such as water-soluble polyvinyl compounds like poly(vinylpyrrolidone) and acrylamide polymers. Other synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates, and those that have cross-linking sites. Preferred high molecular weight materials and resins include poly(vinyl butyral), cellulose acetate butyrate, poly (methylmethacrylate), poly(vinylpyrrolidone), ethyl cellulose, polystyrene, poly(vinylchloride), chlorinated rubbers, polyisobutylene, butadiene-styrene copolymers, copolymers of vinyl chloride and vinyl acetate, copolymers of vinylidene chloride and vinyl acetate, poly(vinyl alcohol) and polycarbonates. When coatings are made using organic solvents, organic soluble resins may be coated by direct mixture into the coating formulations. When coating from aqueous solution, any useful organic soluble materials may be incorporated as a latex or other fine particle dispersion.

Photothermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in *Research Disclosure*, December 1978, Item No. 17643 and *Research Disclosure*, June 1978, Item No. 17029.

The layers of the photothermographic element are coated on a support by coating procedures known in the photographic art, including dip coating, air knife coating, curtain coating or extrusion coating using hoppers. If desired, two or more layers are coated simultaneously.

A photothermographic element as described preferably comprises a thermal stabilizer to help stabilize the photothermographic element prior to exposure and processing. Such a thermal stabilizer provides improved stability of the photothermographic element during storage. Preferred thermal stabilizers are 2-bromo-2-arylsulfonylacetamides, such as 2-bromo-2-p-tolysulfonylacetamide; 2-(tribromomethyl sulfonyl)benzothiazole; and 6-substituted-2,4-bis (tribromomethyl)-s-triazines, such as 6-methyl or 6-phenyl-2,4-bis(tribromomethyl)-s-triazine.

Imagewise exposure is preferably for a time and intensity sufficient to produce a developable latent image in the photothermographic element.

After imagewise exposure of the photothermographic element, the resulting latent image can be developed in a variety of ways. The simplest is by overall heating the element to thermal processing temperature. This overall heating merely involves heating the photothermographic element to a temperature within the range of about 90° C. to about 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 160° C. Heating means known in the photothermographic arts are useful for providing the desired processing temperature for the exposed photothermographic element. The heating means is, for example, a simple hot plate, iron, roller, heated drum, microwave heating means, heated air, vapor or the like.

It is contemplated that the design of the processor for the photothermographic element be linked to the design of the cassette or cartridge used for storage and use of the element. Further, data stored on the film or cartridge may be used to modify processing conditions or scanning of the element. Methods for accomplishing these steps in the imaging system are disclosed by Stoebe, et al. U.S. Pat. No. 6,062,746 and by Szajewski, et al. U.S. Pat. No. 6,048,110, both commonly assigned, which are incorporated herein by reference. The use of an apparatus whereby the processor can be used to write information onto the element, information which can be used to adjust processing, scanning, and image display is also envisaged. This system is disclosed in now allowed Stoebe, et al., U.S. patent applications Ser. Nos. 09/206,914 filed Dec. 7, 1998 and 09/333,092 filed Jun. 15, 1999, which are incorporated herein by reference.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in one or more layers of the element. For example, in some cases, it is desirable to include certain percentages of the reducing agent, toner, stabilizer and/or other addenda in the overcoat layer over the photothermographic image recording layer of the element. This, in some cases, reduces migration of certain addenda in the layers of the element.

In accordance with one aspect of this invention the blocked developer is incorporated in a thermographic element. In thermographic elements an image is formed by imagewise heating the element. Such elements are described in, for example, *Research Disclosure*, June 1978, Item No. 17029 and U.S. Pat. Nos. 3,080,254, 3,457,075 and 3,933,508, the disclosures or which are incorporated herein by reference. The thermal energy source and means for imaging can be any imagewise thermal exposure source and means that are known in the thermographic imaging art. The thermographic imaging means can be, for example, an infrared heating means, laser, microwave heating means or the like.

In view of advances in the art of scanning technologies, it has now become natural and practical for photothermographic color films such as disclosed in EP 0762 201 to be scanned, which can be accomplished without the necessity of removing the silver or silver-halide from the negative, although special arrangements for such scanning can be made to improve its quality. See, for example, Simmons U.S. Pat. No. 5,391,443.

In another embodiment, a photographic element in which at least one color record is represented by an infrared dye can be effectively scanned after partial or incomplete traditional photo processing. More specifically, excellent images are formed by a method of processing an imagewise exposed photographic element comprising developing the imagewise exposed element to form an image and then scanning the element to form an electronic image representation of the developed image in the element, wherein said scanning occurs before complete desilvering of said element and wherein at least one image record of the imagewise exposed photographic element comprises an infrared dye for contributing to the image formation. By way of background, traditional photo-processing of chromogenic color forming elements involves the steps of color development followed by removal of substantially all of the initially incorporated silver halide and developed silver by bleaching, fixing or combined bleach-fixing and such steps as known in the art. Modified photo-processing sequences in which the bleaching or fixing steps are shortened or eliminated entirely are known. Such sequences fail in that they produce images that lack suitable colorfulness for direct optical printing. It is known to scan such partially de-silvered images to produce electronic files suitable for further digital manipulation. These sequences, described for example by Ishikawa et al.

U.S. Pat. No. 6,207,360B, also fall short in terms of image quality and image colorfulness because of the optical distortions induced by the retained silver metal (lack of full bleaching) or by the retained silver halide (lack of full fixing). In one preferred embodiment, a bleaching step is omitted from traditional photo processing. In another preferred embodiment, a fixing step is omitted from traditional photo processing. In yet another preferred embodiment, both bleaching and fixing steps are omitted from traditional photo-processing. In yet another preferred embodiment of the method, only partial desilvering by bleaching, fixing or bleach fixing is preferred. Partial desilvering means removal of at least 80% of the originally incorporated silver or silver halides, more preferably removal of at least 60% of the originally incorporated silver or silver halides, even more preferably removal of at least 40% of the originally incorporated silver or silver halides, especially preferably removal of at least 20% of the originally incorporated silver or silver halides and most preferably no purposeful removal by a bleaching step or fixing step of the originally incorporated silver or silver halides. The infrared-dye forming elements of this invention serve to solve the aforesaid mentioned problems in that by shifting one or more color records towards the infrared region, more faithful scanning of the imagewise-formed image is enabled even in the presence of retained silver or silver halide.

Nevertheless, the retained silver halide can scatter light, decrease sharpness and raise the overall density of the film, thus leading to impaired scanning. Further, retained silver halide can printout to ambient/viewing/scanning light, render non-imagewise density, degrade signal-to noise of the original scene, and raise density even higher. Finally, the retained silver halide and organic silver salt can remain in reactive association with the other film chemistry, making the film unsuitable as an archival media. Removal or stabilization of these silver sources is necessary to render the PTG film to an archival state.

Furthermore, the silver coated in the PTG film (silver halide, silver donor, and metallic silver) is unnecessary to the dye image produced, and this silver is valuable and the desire is to recover it is high.

Thus, it may be desirable to remove, in subsequent processing steps, one or more of the silver containing components of the film: the silver halide, one or more silver donors, the silver-containing thermal fog inhibitor if present, and/or the silver metal. The three main sources are the developed metallic silver, the silver halide, and the silver donor. Alternately, it may be desirable to stabilize the silver halide in the photothermographic film. Silver can be wholly or partially stabilized/removed based on the total quantity of silver and/or the source of silver in the film.

The removal of the silver halide and silver donor can be accomplished with a common fixing chemical as known in the photographic arts. Specific examples of useful chemicals include: thioethers, thioureas, thiols, thiones, thionamides, amines, quaternary anine salts, ureas, thiosulfates, thiocyanates, bisulfites, amine oxides, iminodiethanol-sulfur dioxide addition complexes, amphoteric amines, bis-sulfonylmethanes, and the carbocyclic and heterocyclic derivatives of these compounds. These chemicals have the ability to form a soluble complex with silver ion and transport the silver out of the film into a receiving vehicle. The receiving vehicle can be another coated layer (laminate) or a conventional liquid processing bath.

The stabilization of the silver halide and silver donor can also be accomplished with a common stabilization chemical. The previously mentioned silver salt removal compounds can be employed in this regard. With stabilization, the silver is not necessarily removed from the film, although the fixing agent and stabilization agents could very well be a single chemical. The physical state of the stabilized silver is no longer in large (>50 nm) particles as it was for the silver halide and silver donor, so the stabilized state is also advantaged in that light scatter and overall density is lower, rendering the image more suitable for scanning.

The removal of the metallic silver is more difficult than removal of the silver halide and silver donor. In general, two reaction steps are involved. The first step is to bleach the metallic silver to silver ion. The second step may be identical to the removal/stabilization step(s) described for silver halide and silver donor above. Metallic silver is a stable state that does not compromise the archival stability of the PTG film. Therefore, if stabilization of the PTG film is favored over removal of silver, the bleach step can be skipped and the metallic silver left in the film. In cases where the metallic silver is removed, the bleach and fix steps can be done together (called a blix) or sequentially (bleach+fix).

The process could involve one or more of the scenarios or permutaions of steps. The steps can be done one right after another or can be delayed with respect to time and location. For instance, heat development and scanning can be done in a remote kiosk, then bleaching and fixing accomplished several days later at a retail photofinishing lab. In one embodiment, multiple scanning of images is accomplished. For example, an initial scan may be done for soft display or a lower cost hard display of the image after heat processing, then a higher quality or a higher cost secondary scan after stabilization is accomplished for archiving and printing, optionally based on a selection from the initial display.

For illustrative purposes, a non-exhaustive list of photothermographic film processes involving a common dry heat development step are as follows:

1. heat development=>scan=>stabilize (for example, with a laminate)=>scan=>obtain returnable archival film.
2. heat development=>fix bath=>water wash=>dry=>scan=>obtain returnable archival film
3. heat development=>scan=>blix bath=>dry=>scan=>recycle all or part of the silver in film
4. heat development=>bleach laminate=>fix laminate=>scan=>(recycle all or part of the silver in film)
5. heat development=>scan=>blix bath=>wash=>fix bath=>wash=>dry=>obtain returnable archival film
6. heat development=>relatively rapid, low quality scan
7. heat development=>bleach=>wash=>fix=>wash=>dry=>relatively slow, high quality scan Turning now to Type II processing, this refers to low volume processing ("substantially dry" or "apparently dry") which is defined as photothermographic processing where the volume of applied developer solution is between about 0.1 to about 10 times, preferably about 0.5 to about 10 times, the volume of solution required to swell the photographic element. This processing may take place by a combination of solution application, external layer lamination, and heating. The low volume processing system may contain any of the elements described above for Type I: Photothermographic systems. In addition, it is specifically contemplated that any components described in the preceding sections that are not necessary for the formation or stability of latent image in the origination film element can be removed from the film element altogether and contacted at any time after exposure for the purpose of carrying out photographic processing, using the methods described below.

The Type II photographic element may receive some or all of the following treatments:

(I) Application of a solution directly to the film by any means, including spray, inkjet, coating, gravure process and the like.

(II) Soaking of the film in a reservoir containing a processing solution. This process may also take the form of dipping or passing an element through a small cartridge.

(III) Lamination of an auxiliary processing element to the imaging element. The laminate may have the purpose of providing processing chemistry, removing spent chemistry, or transferring image information from the latent image recording film element. The transferred image may result from a dye, dye precursor, or silver containing compound being transferred in a image-wise manner to the auxiliary processing element.

(IV) Heating of the element by any convenient means, including a simple hot plate, iron, roller, heated drum, microwave heating means, heated air, vapor, or the like. Heating may be accomplished before, during, after, or throughout any of the preceding treatments I–III. Heating may cause processing temperatures ranging from room temperature to 100° C.

Once yellow, magenta, and cyan dye image records have been formed in the processed photographic elements of the invention, conventional techniques can be employed for retrieving the image information for each color record and manipulating the record for subsequent creation of a color balanced viewable image. For example, it is possible to scan the photographic element successively within the blue, green, and red regions of the spectrum or to incorporate blue, green, and red light within a single scanning beam that is divided and passed through blue, green, and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. Most generally this electronic signal is further manipulated to form a useful electronic record of the image. For example, the electrical signal can be passed through an analog-to-digital converter and sent to a digital computer together with location information required for pixel (point) location within the image. In another embodiment, this electronic signal is encoded with colorimetric or tonal information to form an electronic record that is suitable to allow reconstruction of the image into viewable forms such as computer monitor displayed images, television images, printed images, and so forth.

It is contemplated that many of imaging elements of this invention will be scanned prior to the removal of silver halide from the element. The remaining silver halide yields a turbid coating, and it is found that improved scanned image quality for such a system can be obtained by the use of scanners that employ diffuse illumination optics. Any technique known in the art for producing diffuse illumination can be used. Preferred systems include reflective systems, that employ a diffusing cavity whose interior walls are specifically designed to produce a high degree of diffuse reflection, and transmissive systems, where diffusion of a beam of specular light is accomplished by the use of an optical element placed in the beam that serves to scatter light. Such elements can be either glass or plastic that either incorporate a component that produces the desired scattering, or have been given a surface treatment to promote the desired scattering.

One of the challenges encountered in producing images from information extracted by scanning is that the number of pixels of information available for viewing is only a fraction of that available from a comparable classical photographic print. It is, therefore, even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

The elements of the invention can have density calibration patches derived from one or more patch areas on a portion of unexposed photographic recording material that was subjected to reference exposures, as described by Wheeler et al U.S. Pat. No. 5,649,260, Koeng at al U.S. Pat. No. 5,563,717, and by Cosgrove et al U.S. Pat. No. 5,644,647.

Illustrative systems of scan signal manipulation, including techniques for maximizing the quality of image records, are disclosed by Bayer U.S. Pat. No. 4,553,156; Urabe et al U.S. Pat. No. 4,591,923; Sasaki et al U.S. Pat. No. 4,631,578; Alkofer U.S. Pat. No. 4,654,722; Yamada et al U.S. Pat. No. 4,670,793; Klees U.S. Pat. Nos. 4,694,342 and 4,962,542; Powell U.S. Pat. No. 4,805,031; Mayne et al U.S. Pat. No. 4,829,370; Abdulwahab U.S. Pat. No. 4,839,721; Matsunawa et al U.S. Pat. Nos. 4,841,361 and 4,937,662; Mizukoshi et al U.S. Pat. No. 4,891,713; Petilli U.S. Pat. No. 4,912,569; Sullivan et al U.S. Pat. Nos. 4,920,501 and 5,070,413; Kimoto et al U.S. Pat. No. 4,929,979; Hirosawa et al U.S. Pat. No. 4,972,256; Kaplan U.S. Pat. No. 4,977,521; Sakai U.S. Pat. No. 4,979,027; Ng U.S. Pat. No. 5,003,494; Katayama et al U.S. Pat. No. 5,008,950; Kimura et al U.S. Pat. No. 5,065,255; Osamu et al U.S. Pat. No. 5,051,842; Lee et al U.S. Pat. No. 5,012,333; Bowers et al U.S. Pat. No. 5,107,346; Telle U.S. Pat. No. 5,105,266; MacDonald et al U.S. Pat. No. 5,105,469; and Kwon et al U.S. Pat. No. 5,081,692. Techniques for color balance adjustments during scanning are disclosed by Moore et al U.S. Pat. No. 5,049,984 and Davis U.S. Pat. No. 5,541,645.

The digital color records once acquired are in most instances adjusted to produce a pleasingly color balanced image for viewing and to preserve the color fidelity of the image bearing signals through various transformations or renderings for outputting, either on a video monitor or when printed as a conventional color print. Preferred techniques for transforming image bearing signals after scanning are disclosed by Giorgianni et al U.S. Pat. No. 5,267,030, the disclosures of which are herein incorporated by reference. Further illustrations of the capability of those skilled in the art to manage color digital image information are provided by Giorgianni and Madden *Digital Color Management*, Addison-Wesley, 1998.

EXAMPLE

A multilayer, multicolor light sensitive Element A was prepared having a support bearing a red light sensitive silver halide layer having Coupler 1, a green light sensitive silver halide layer having Coupler 2, and a blue light sensitive silver halide layer having Coupler 3. Element A contained subbing layers, overcoat layers and other components as known in the art. Element B was like element A except Coupler 2 was replaced by Coupler 4 in the green light sensitive layer unit and Coupler 3 was replaced by Coupler 2 in the blue light sensitive layer unit. Element C was like Element B except that Coupler 1 was replaced by Coupler 4 in the red light sensitive layer unit and Coupler 4 was replaced by Coupler 1 in the green light sensitive layer unit. The three elements were slit and perforated to 135 film format, loaded into cartridges and exposed to test scenes using a camera. After development using developer D-1, Element A exhibited yellow, magenta and cyan colored images, Elements B and C each exhibited magenta, cyan and infrared colored images. The elements were not desilvered by bleaching or fixing. Below are the structures of the above-mentioned compounds:

Coupler 1

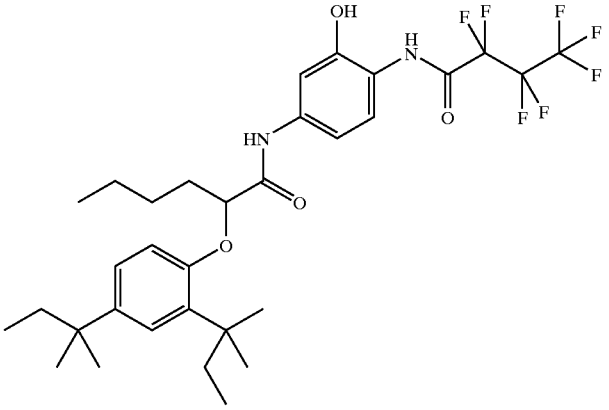

Coupler 2

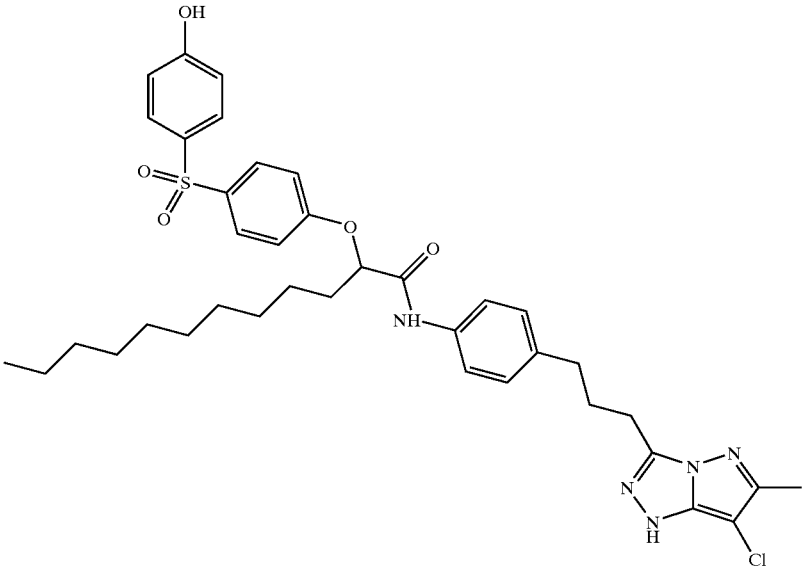

-continued

Cpoupler 3

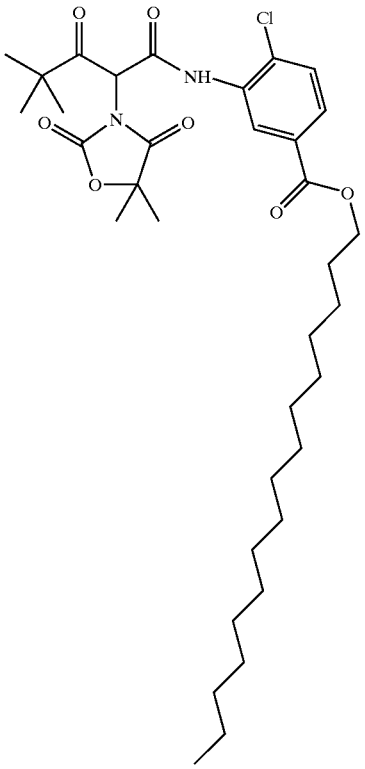

Coupler 4

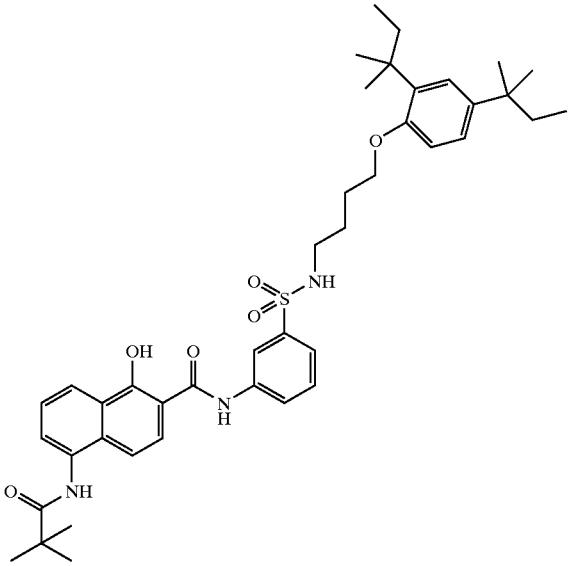

D-1

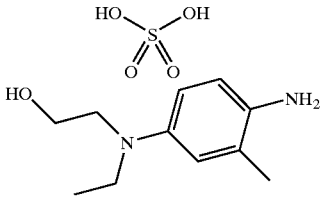

D-2

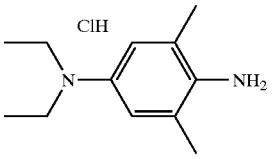

Table 1 below shows the percent transmission of elements in selected wavelength ranges after development. Table 2 below shows the hue of images in elements A, B and C after development.

TABLE 1

| % T at 450 nm | % T at 550 nm | % T at 650 nm | % T at 750 nm | % T at 850 nm |
|---|---|---|---|---|
| 12% | 18% | 28% | 34% | 38% |

TABLE 2

| Element | Hue of red layer image | Hue of green layer image | Hue of Blue layer image |
|---|---|---|---|
| A | 664.3 nm | 551.5 nm | 449.0 nm |
| B | 664.3 nm | 753.9 nm | 551.5 nm |
| C | 753.9 nm | 664.3 nm | 551.5 nm |

The MTF percent responses were measured after a white light exposure. The MTF percent response to 450 nm light was 80% while to 750 nm light was 105%, thus confirming the improved specularity of light transmission through the element when it was scanned in the infrared region.

As is readily apparent, matching the hues of the formed dyes to wavelengths of light where silver halides are more transmissive results in the formation of images that are more readily scanned.

The images formed in elements A, B and C were scanned to blue, green, red or IR light as appropriate for the dye records formed and the images were reconstructed and formed to prints. The prints from Elements B and C were colorful and showed an improved blue record image relative to that obtained from Element A, thus confirming the advantages of the invention.

In a separate experiment, an element formulated like Element A was developed using developer D-2. Shifted color records were formed having absorption maxima at 471.9 nm, 615.1 nm and 719.4 nm.

In a separate experiment, an element formulated like Element C can be developed using developer D-2. Shifted color records are formed having absorption maxima at 615.1 nm, 719.4 nm and at 800 nm.

Elements can be prepared using appropriately blocked versions of D-1 and D-2 along with melt formers and incorporated silver salts to prepare photothermographic elements that form shifted color records suitable for scanning after imagewise exposure and heating. Examples of photothermographic elements that can be modified according to the present invention are disclosed in commonly assigned U.S. Ser. No. 60/211,061, hereby incorporated by reference in its entirety.

In another embodiment, blocked variants of D-1 and D-2 can be delivered to the light sensitive elements from laminates to enable formation of shifted color records suitable for scanning.

The invention has been described in detail with particular reference to certain preferred embodiments thereof, but it will be understood that variations and modifications can be effected within the spirit and scope of the invention.

What is claimed is:

1. A light-sensitive color photographic element for recording an image comprising a support and, coated on the support, a plurality of hydrophilic-colloid layers, comprising radiation-sensitive silver-halide emulsions and dye image-forming couplers, forming three image recording layer units for separately recording blue, green, and red exposures, wherein the dye-image-forming coupler in at least one the three image recording layer units consists essentially of an infrared dye-forming coupler for color image formation.

2. The photographic element of claim 1 wherein the element comprises a blue light-sensitive layer unit having a magenta dye forming coupler, a green light-sensitive layer having a cyan dye-forming coupler, and a red light-sensitive layer having the infrared dye-forming coupler.

3. The photographic element of claim 1 wherein the at least one image recording layer comprises a developing agent or precursor thereof in reactive association with the infrared dye-forming coupler that together forms a dye having an absorption in the infrared region.

4. The photographic element of claim 1 wherein the element is a photothermographic film.

5. The photographic element of claim 3, wherein the element comprises only magenta, cyan and infrared dye-forming couplers in reactive association with a developing agent.

6. The photographic element of claim 5, wherein the developing agent is a paraphenylene compound selected from the group consisting of 4-N,N-dialkylaminoanilines and 2-alkyl-4-N,N-dialkylaminoanilines.

7. The photographic element of claim 4, wherein the photothermographic element comprises at least one blue light-sensitive layer comprising a magenta dye-forming coupler, at least one green light-sensitive layer having a cyan dye-forming coupler, and at least one red light-sensitive layer having the infrared dye-forming coupler instead of a cyan dye-forming coupler.

8. The photographic element of claim 1 in which the only couplers present are a cyan dye-forming coupler, a near-infrared dye-forming coupler, and a far-infrared dye forming coupler.

9. The photographic element of claim 1, wherein the element has only magenta, cyan and infrared dye-forming couplers in combination with a paraphenylene diamine developer or precursor thereof that shifts the hue of the cyan and infra-red dye-forming couplers to a near-infrared and far-infrared dye.

10. The photographic element of claim 1 in which the total amount of color masking coupler is not more than 0.2 $mmol/m^2$.

11. The photographic element of claim 1 in which the total amount of permanent Dmin adjusting dyes is not more than 0.2 $mmol/m^2$.

12. The photographic element of claim 1 in which the permanent antihalation density is not more than 0.3 in the blue, green and red density.

13. A light-sensitive color photographic element comprising a support and, coated on the support, a plurality of hydrophilic colloid layers, comprising radiation-sensitive silver-halide emulsion and dye image-forming couplers, forming three recording layer units for separately recording blue, green, and red exposures, wherein the dye image-forming couplers in the element consists essentially of yellow, magenta and cyan dye-forming couplers and a developing agent or precursor thereof that is capable of shifting the hue of the dye formed by the cyan dye-forming coupler to the infrared for color image formation.

14. The photographic element of claim 13, wherein the developing agent is of a paraphenylene diamine compound.

15. The photographic element of claim 14, wherein the hue-shifting developing agent is a 2,5-dialkyl-4-N,N-dialkylaminoaniline.

16. A light-sensitive color photothermographic element for recording an image comprising a support and, coated on the support, a plurality of hydrophilic-colloid layers, comprising radiation-sensitive silver-halide emulsions and dye image-forming couplers, and forming three image recording layer units for separately recording blue, green, and red exposures, wherein the dye image-forming couplers in at least one of the three image recording layer units consists essentially of infrared dye-forming coupler for color image formation, wherein the infrared dye-forming coupler is capable of forming, in reactive association with an incorporated developing agent or precursor thereof, an infrared dye; and wherein the element comprises a blue light-sensitive layer unit having a magenta dye forming coupler, a green light-sensitive layer having a cyan dye-forming coupler, and a red light-sensitive layer having said infrared dye-forming coupler.

* * * * *